US005485185A

United States Patent [19]

Sueoka et al.

[11] Patent Number: 5,485,185

[45] Date of Patent: Jan. 16, 1996

[54] INK JET RECORDING HEAD, AN INK JET RECORDING APPARATUS PROVIDED WITH SAID RECORDING HEAD, AND PROCESS FOR THE PRODUCTION OF SAID INK JET RECORDING HEAD

[75] Inventors: Manabu Sueoka, Yokohama; Makoto Shibata, Kawasaki; Hirokazu Komuro, Yokohama, all of Japan

[73] Assignee: Canon Kabushiki Kaisha, Tokyo, Japan

[21] Appl. No.: 128,109

[22] Filed: Sep. 29, 1993

[30] Foreign Application Priority Data

Sep. 29, 1992 [JP] Japan ..... 4-260265
Jan. 27, 1993 [JP] Japan ..... 5-011853

[51] Int. Cl.[6] ..... B41J 2/01
[52] U.S. Cl. ..... 347/64
[58] Field of Search ..... 347/63, 64, 65

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/104 R |
| 4,723,129 | 2/1988 | Endo et al. | 346/1.1 |
| 4,740,796 | 4/1988 | Endo et al. | 346/1.1 |
| 4,860,033 | 8/1989 | Shiozaki et al. | 346/140 R |
| 4,881,318 | 11/1989 | Komuro et al. | 29/827 |
| 5,081,474 | 1/1992 | Shibata et al. | 346/140 R |

FOREIGN PATENT DOCUMENTS

| | | | |
|---|---|---|---|
| 58-224758 | 12/1983 | Japan . | |
| 58-224757 | 12/1983 | Japan . | |
| 59-1268 | 1/1984 | Japan . | |
| 59-123670 | 7/1984 | Japan . | |
| 59-138461 | 8/1984 | Japan . | |
| 135753 | 6/1986 | Japan | 347/64 |
| 3-61045 | 3/1991 | Japan . | |

*Primary Examiner*—N. Le
*Attorney, Agent, or Firm*—Fitzpatrick, Cella, Harper & Scinto

[57] ABSTRACT

An ink jet recording head which includes a substrate for ink jet recording head and a nozzle structural body provided with a plurality of nozzle-forming walls which is disposed over said substrate for ink jet recording head, said substrate for ink jet recording head comprising a base member, a heat generating resistor capable of generating, upon energization, thermal energy to be utilized for discharging ink, a pair of electrodes electrically connected to said heat generating resistor, a first protective layer, and a second protective layer wherein said heat generating resistor and said pair of electrodes are arranged on said base member, and said first protective layer and said second protective layer are disposed in this order over said heat generating resistor and said pair of electrodes, wherein a plurality of given portions of said second protective layer each situated at a position where said nozzle structural body is joined through one of said nozzle-forming walls to said substrate for ink jet recording head are recessed while leaving opposite stepped portions of said second protective layer situated above said pair of electrodes. A ink jet recording apparatus provided with said ink jet recording head.

18 Claims, 8 Drawing Sheets

INK JET RECORDING HEAD, AN INK JET RECORDING APPARATUS PROVIDED WITH SAID RECORDING HEAD, AND PROCESS FOR THE PRODUCTION OF SAID INK JET RECORDING HEAD

BACKGROUND OF THE INVENTION

1. Field of the Invention

The present invention relates to an improvement in an ink jet recording head for performing recording by discharging recording liquid (ink) through a discharging outlet by the aid of heat energy. More particularly, the present invention relates to an improved ink jet recording head provided with an improved protective layer of a specific configuration, which excels in adhesion between nozzle-forming walls and a substrate for ink jet recording head (this substrate will be hereinafter referred to as ink jet recording head substrate). The present invention further relates to an ink jet recording apparatus provided with said ink jet recording head.

The present invention includes a process for producing said improved ink jet recording head.

2. Description of Related Background Art

There have been proposed a number of ink jet recording systems for performing recording on a record medium such as papers, plastic sheets, fabrics, etc. by discharging or ejecting recording liquid (ink) through discharging outlets by the aid of heat energy. These ink jet recording systems are advantageous since they are non-impact type recording systems and low in noise, and there is not any particular restriction for record mediums to used for performing recording thereon. Further as for apparatus, particularly ink jet recording apparatus for practicing such recording system, there are advantages such that the apparatus can be made up of a relatively simple structure, a plurality of liquid jetting nozzles (liquid discharging outlets in other words) can be arranged at a relatively high density, and the apparatus can be relatively easily designed so that they can be operated at a high speed. Therefore, public attention has been focused on these ink jet recording systems, and various studies have been made on them.

Incidentally, there are known a number of ink jet recording apparatus suitable for practicing such ink jet recording system.

FIGS. 6(*a*) and 6(*b*) are of an example of a recording head used in such ink jet recording apparatus. Particularly, FIG. 6(*a*) is a schematic perspective view illustrating a principal part of the ink jet head. FIG. 6(*b*) is a schematic cross sectional view illustrating a cross section, taken at the face perpendicular to the substrate and along the liquid pathway of the recording head shown in FIG. 6(*a*).

As apparent from FIGS. 6(*a*) and 6(*b*), the recording head is generally provided with a plurality of ink discharging outlets 7 for discharging recording liquid such as ink and liquid pathways 6 respectively corresponding to each of the discharging outlets 7. The liquid pathways 6 are communicated with a common liquid chamber 9 in which recording liquid to be supplied is stored. Each of the liquid pathways 6 is provided with a heat generating resistor 2*a* capable of generating, when energized, heat energy to be utilized for discharging the recording liquid and wirings 3*a* and 3*b* which serve to supply an electric signal to the heat generating resistor 2*a*. The heat generating resistors 2*a* and the wirings 3*a* and 3*b* are arranged on an ink jet recording head substrate 8.

The ink jet recording head substrate 8 is provided with a first protective layer 4 and a second protective layer 5 which serve to protect the wirings 3*a* and 3*b* and the heat generating resistor 2*a* disposed on the ink jet recording head substrate. Particularly, the first protective layer 4 is disposed aiming at preventing the heat generating resistor 2*a* and the wirings 3*a* and 3*b* from contacting with the recording liquid or receiving penetration the recording liquid which results in suffering from electric erosion or dielectric breakdown. Similarly, the second protective layer 5 is disposed aiming at preventing the heat generating resistor 2*a* from being affected by shock waves caused upon extinction of bubbles produced at the time of discharging the recording liquid (the shock waves will be hereinafter referred to as cavitation).

The protective layer 4 is usually composed of an insulating and heat resistant material. Examples of such insulating and heat resistant material are inorganic oxides such as silicon oxide ($SiO_2$), etc.; transition metal oxides such as, titanium oxide, vanadium oxide, niobium oxide, molybdenum oxide, tantalum oxide, tungsten oxide, chromium oxide, zirconium oxide, hafnium oxide, lanthanum oxide, yttrium oxide, manganese oxide, etc.; metal oxides such as aluminum oxide, calcium oxide, strontium oxide, barium oxide, etc., and complexes of these; and nitrides such as silicon nitride, aluminum nitride, boron nitride, etc., and oxides of these. Among these materials, $SiO_2$, $Si_3N_4$, $Ta_2O_5$, and the like are the most desirably used in the viewpoints of easiness in processing, stability and easy accessibility.

The second protective layer 5 is usually composed of a material which is superior in resistance to ink (resistance to chemicals or chemical stability in other wards) and also in resistance to cavitation (mechanical strength in other words). Examples of such material are metals of group III*a* of the periodic table such as Ta, etc.; metals of group IV*a* of the periodic table such as Ti, etc.; metals of group V*a* of the periodic table such as V, etc.; metals of group VI*a* of the periodic table such as Cr, etc.; metals of group VIII such as Fe, Pt, Ir, etc.; and alloys of these metals such as Ti-Ni, Ta-W, Fe-Ni-Cr, etc. Among these, Ta, Cr, Pt, and the like are the most desirably used in the viewpoints of easiness in processing, stability and easy accessibility.

Incidentally, in recent years, there is an increased demand in the field of recording using an ink jet recording system for early provision of such a recording apparatus which enables one to obtain a high quality recorded image of high definition at an improved speed.

Similarly, there is also an increased demand for early provision of such a recording head in that any kinds of inks, particularly inks having improved characteristics employable for any of commercially available record mediums such as papers, plastic sheets, fabrics, etc. can be optionally used.

There presently exist the following four subjects of ink jet technique to be overcome in order to cope with these demands: (a) accomplishment of nozzle arrangement at an improved density, (b) elongation of a recording head, (c) correspondence to high frequency driving, and (d) relaxation of the restriction for the kind of ink to be used.

In the following, description will be made of each of these four technical subjects (a) to (d).

With respect to the technical subject (a) (which concerns "accomplishment of nozzle arrangement at an improved density"):

To arrange a plurality of nozzles (discharging outlets in other words) at an improved density is necessitated in order to improve the quality of an image recorded. The nozzle density (that is, the number of nozzles to be arranged per 1 inch) (the nozzle density will be hereinafter sometimes expressed by the term "dpi") of the conventional recording head is 360 dpi. In order to obtain a recorded image of further improved definition, the nozzle density of a recording head is necessary to be 400 dpi or above. And in order to realize the nozzle arrangement at such high dpi without reducing the driving high frequency, it is necessary for the width of the liquid pathway of each nozzle to be maintained at an extent substantially equivalent to that in the conventional recording head. For this purpose, the width of a nozzle-forming wall present between each pair of the adjacent nozzles is unavoidably necessary to be properly narrowed. However, in this case, a drawback is occurred in that the area where the wall of each nozzle (that is, each nozzle-forming wall) is contacted with the recording head substrate becomes very small to result in making the adhesion between the nozzle-forming walls and the recording head substrate insufficient.

For instance, in the case where the adhesion between the nozzle-forming walls and the recording head substrate is not insured, ink in the liquid pathway is vibrated by receiving an influence of a bubble produced at a given nozzle upon driving the ink jet head for discharging the ink. This results in affecting the adjacent nozzles situated next to that nozzle, wherein the direction in which ink droplet is discharged is often varied. In this case, arrival of ink droplets onto a record medium is varied to deteriorate the quality of an image to be recorded on the record medium. Consequently, an expected effect by the arrangement of a plurality of nozzles at a high dpi cannot be achieved.

In view of what above described, it is understood that in order to attain highly dense arrangement of nozzles in an ink jet recording head, it is an important factor to attain an extremely firm contact between the nozzle-forming walls and the recording head substrate.

With respect to the technical subject (b) (which concerns "elongation of a recording head"):

As the structure of a recording head capable of attaining high speed recording, there is considered elongation of the recording head, for example, by making the width of the recording head to be of an extent which is substantially equivalent to the recording width of a record medium on which a record is to be performed.

As for an ink jet recording head, the material by which the substrate therefor is constituted is usually different from that by which the nozzle-forming walls are constituted. Hence, in the step of joining the nozzle-forming walls to the ink jet recording head substrate at the time of producing recording head, a stress is somewhat caused between the recording head substrate and the nozzle-forming walls. The influence of such stress is increased as the width of the recording head substrate is elongated. This situation entails a problem in the case of producing a lengthy ink jet recording head in that the resulting lengthy recording head becomes such that is liable to cause removal of the nozzle-forming walls from the recording head substrate when it is used for recording.

In fact, in the case where the ink jet recording head is one in which heat energy is utilized, removal of the head substrate from the nozzle-forming walls joined thereto is likely to occur due to heat generated at the time of performing recording because the thermal expansion on the side of the recording head substrate is different from that on the nozzle-forming wall side. This tendency becomes significant as the recording head is elongated.

In consequence, it is understood that in order to attain highly dense arrangement of nozzles in an ink jet recording head, it is an important factor to extremely firmly contact the nozzle-forming walls with the head substrate so that no removal is caused between the two due to the difference between their constituent materials.

With respect to the technical subject (c) (which concerns "correspondence to high frequency driving"):

In the case of performing high speed recording using an ink jet recording head, the ink jet recording head is driven with a high frequency. In order to continuously discharge ink through the discharging nozzles (or outlets) with a high frequency in that case, those nozzles are required to be always filled with ink instantly after ink has been discharged. In order for the nozzles to be effectively and smoothly filled with ink instantly after ink has been discharged, the inside of each nozzle is necessary to be made small as much as possible so that efficient ink flow is facilitated. For attaining this purpose, the width of each nozzle is desired to be widened. As a means of widening the width of each nozzle without enlarging the size of the recording head, there is considered only a manner of narrowing the width of each nozzle-forming wall at the present time. However, such manner entails a drawback in that the width of each nozzle-forming wall which is adopted to contact with the ink jet recording head substrate unavoidably becomes relatively small and this leads to deteriorating the reliability of adhesion between the nozzle-forming walls and the ink jet recording head substrate.

In order to diminish the ink flow resistance in the inside of each nozzle (that is, the ink discharging nozzle), there is considered such a nozzle designing that the length of each nozzle is shortened. However, this nozzle designing provides a problem in that the area where each nozzle-forming wall is contacted with the ink jet recording head substrate unavoidably becomes small, resulting in deteriorating the reliability of adhesion between the nozzle-forming walls and the ink jet recording head substrate.

In consequence, it is understood that in order to achieve desirable correspondence of an ink jet recording head to high frequency driving, it is an important factor to extremely firmly contact the nozzle-forming walls with the ink jet recording head substrate.

With respect to the technical subject (d) (which concerns "relaxation of the restriction for the kind of ink to be used"):

In order to enable an ink jet recording apparatus to provide desirable recorded images on any of commercially available record mediums, a due care should be made also about ink to be used.

For instance, in order to make it possible to provide desirable recorded images on any record medium by an ink jet recording apparatus, it is considered to use ink with a high dye concentration. However, the ink with a high dye concentration is usually added with urea for the purpose of preventing the dye from being agglomerated therein. The urea-containing ink exhibits an alkaline property as a result of decomposition of the urea therein. For the alkaline ink, there is a tendency that it permeates into the joint portion between the ink jet recording head substrate and the nozzle-forming walls, resulting in deteriorating the adhesion between them. Particularly, in the case of using a lengthy ink jet recording head or an ink jet recording head of highly dense nozzle arrangement, said tendency becomes significant because each nozzle-forming wall is thinned as above described, wherein the nozzle-forming walls are apt to relatively easily remove from the ink jet recording head substrate because of such penetration of the alkaline ink. Therefore, alkaline ink, particularly ink added with urea is not usable in such lengthy ink jet recording head of highly dense nozzle arrangement because a problem is liable to occur in that the reliability of the recording head is deteriorated.

However, if extremely firm adhesion could be achieved for the joint of the ink jet recording head substrate with the nozzle-forming walls, the foregoing problem relative to penetration of ink into the joint portion between the ink jet recording head substrate and the nozzle-forming walls can be overcome and as a result, such restriction for the kind of ink to be used can be relaxed, wherein such alkaline ink becomes usable. This situation leads to relaxing the restriction for the kind of a record medium to be used, wherein any of commercially available record mediums becomes usable. In consequence, the application domain of the ink jet recording apparatus can be expanded further.

As apparent from what above described, it is understood that it is an important factor to extremely firmly contact the nozzle-forming walls with the ink jet recording head substrate in order to provide a high-performance ink jet recording head.

By the way, as for contact of walls of discharging nozzles (discharging outlets) with an ink jet recording head substrate in order to obtain an ink jet recording head, various proposals have been made such as will be under described.

For example, Japanese Patent Laid-open No. 224757/1983 or Japanese Patent Laid-open No. 1268/1984 discloses a technique of treating a joint face of an ink jet recording head substrate with nozzle-forming walls with the use of a silane coupling agent in order to obtain ink jet recording head.

This technique is effective in the case of producing an ink jet recording head of the conventional configuration. However, it is not effective in the case of producing an ink jet recording head which can attain the foregoing technical subjects: (a) accomplishment of nozzle arrangement at an improved density, (b) elongation of a recording head, (c) correspondence to high frequency driving, and (d) relaxation of the restriction for the kind of ink to be used, because the area where a given nozzle-forming wall is joined with a ink jet recording head substrate is necessary to be extremely small and therefore, it is extremely difficult to ensure a sufficient adhesion for the joint between them even by employing the above joining technique.

Japanese Patent Laid-open No. 224758/1983 discloses a technique for obtaining an ink jet recording head, wherein an inorganic oxide layer or an inorganic nitride layer is formed in the vicinity of ink discharging nozzles (or outlets) to be provided and nozzle-forming walls are then formed at such layer with the use of a silane coupling agent to thereby improve adhesion for the joint of the nozzle-forming walls with an ink jet recording head substrate. Although this technique is effective in improving the adhesion of the nozzle-forming walls with the ink jet recording head substrate, it is difficult to ensure the adhesion between the nozzle-forming wall situated at the ink pathway portion and the ink jet recording head substrate by this technique.

In the above, consideration has been made in terms of adhesion between the ink jet recording head substrate as a constituent of an ink jet recording head and the nozzle-forming walls. Additional consideration should be made as for the constituent materials of the ink jet recording head substrate in order to attain the foregoing technical subjects. That is, it is important for the ink jet recording head substrate to be free of problems relative to removal of the constituent materials thereof in order to attain the foregoing technical subjects.

In the following, description will be made of the problems which are liable to occur at joint portions of the constituent materials of the ink jet recording head substrate.

In the ink jet recording head substrate shown in FIGS. 6(*a*) and 6(*b*), as above described, the first protective layer is composed of an insulating and heat resistant material which is different from the metal material of the second protective layer. Because of this, there is a problem in that the two layers are liable to peel off one from the other upon performing recording using the ink jet recording head. In addition, the material by which the second protective layer is constituted is different from the constituent material of the nozzle walls. Because of this, especially in the case where the ink jet recording head is made to be an elongated one, removal is liable to occur at the joint portions of the second protective layer with the nozzle-forming walls due to heat generated upon performing recording.

Japanese Patent Laid-open No. 61045/1991 describes an improved ink jet recording head substrate having two protective layers, that is, a first protective layer and a second protective layer as illustrated in FIGS. 8(*a*) and (*b*). FIG. 8(*a*) is a schematic plan view of the ink jet recording head of the configuration in which an improvement is made to prevent occurrence of removal at the two protective layers. FIG. 8(*b*) is a schematic sectional view, taken along the line X—Y in FIG. 8(*a*).

In FIGS. 8(*a*) and 8(*b*), reference numeral 1 indicates a base member, and reference numeral 2 indicates a heat generating resistor formed on the base member 1. Each of reference numerals 3*a* and 3*b* indicates an electrode layer. The electrode layer 3*a* serves as a selective electrode, and the electrode layer 3*b* serves as a common electrode. Reference numeral 4 indicates a first protective layer composed of an insulating and heat resistant material, and reference numeral 5 indicates a second protective layer composed of a material which is different from the material by which the first protective layer is constituted. In the configuration shown in FIGS. 8(*a*) and 8(*b*), one of the electrodes 3*a* and 3*b* is formed on every other heat generating resistor 2 formed on the base member 1. The first protective layer 4 is formed so as to enclose the heat generating resistors 2 and the electrodes 3*a* and 3*b* as shown in FIG. 8(*b*). The second protective layer 5 is spacedly formed on every portion of the first protective layer 4 under which the heat generating resistor 2 is situated. According to this configuration, the area for the second protective later to be contacted with the first protective layer can be minimized and because of this, the influence of distortion due to a difference between the stress of the first protective layer and that of the second protective layer can be greatly diminished. Hence, it is understood that problems relative to occurrence of distortion among the two protective layers can be solved according to the configuration proposed by Japanese Patent Laid-open No. 61045/1991.

However, this Japanese patent literature does not teach or suggest any effective manner of improving the adhesion between an ink jet recording head substrate and nozzle walls disposed thereon.

SUMMARY OF THE INVENTION

A principal object of the present invention is to overcome the foregoing technical subjects (a) to (d) in the conventional ink jet recording head, which particularly concern the adhesion between the ink jet recording head substrate and the nozzle-forming walls.

Other object of the present invention is to provide an improved ink jet recording head capable of being driven with a high frequency in which a plurality of ink discharging nozzles (or outlets) are arranged at a high density and which enables one to use any kind of ink as a recording liquid without any particular restriction therefor, wherein the substrate for ink jet recording head is firmly contacted with the nozzle-forming walls with an improved adhesion.

A further object of the present invention is to provide an elongated, improved ink jet recording head capable of being driven at a high frequency in which a plurality of ink discharging nozzles (or outlets) are arranged at a high density and which enables one to use any kind of ink as a recording liquid without any particular restriction therefor, wherein the substrate for ink jet recording head is firmly contacted with the nozzle-forming walls with an improved adhesion.

A further object of the present invention is to provide a process for producing, at an improved yield and at a reduced production cost, an improved ink jet recording head capable of being driven with a high frequency in which a plurality of ink discharging nozzles (or outlets) are arranged at a high density and which enables one to use any kind of ink as a recording liquid without any particular restriction therefor, wherein the substrate for ink jet recording head is firmly contacted with the nozzle-forming walls with an improved adhesion.

A further object of the present invention is to provide a process for producing, at an improved yield and at a reduced production cost, an elongated, improved ink jet recording head capable of being driven at a high frequency in which a plurality of ink discharging nozzles (or outlets) are arranged at a high density and which enables one to use any kind of ink as a recording liquid without any particular restriction therefor, wherein the substrate for ink jet recording head is firmly contacted with the nozzle-forming walls with an improved adhesion.

A further object of the present invention is to provide a highly reliable, improved ink jet recording apparatus which provides high quality recorded images.

BRIEF DESCRIPTION OF THE DRAWINGS

FIG. 1(*b*) is a schematic sectional view, taken along the line X—Y in FIG. 1(*a*).

FIG. 2(*b*) is a schematic plan view of the ink jet recording head shown in FIG. 2(*a*).

FIG. 2(*c*) is a schematic sectional view, taken along the line X—Y in FIG. 2(*b*).

FIG. 3(*b*) is a schematic plan view of the ink jet recording head shown in FIG. 3(*a*).

FIG. 3(*c*) is a schematic sectional view, taken along the line X—Y in FIG. 3(*b*).

FIG. 6(*b*) is a schematic sectional view of the ink jet recording head shown in FIG. 6(*a*).

FIG. 8(*b*) is a schematic sectional view, taken along the line X—Y in FIG. 8(*a*).

DESCRIPTION OF THE INVENTION

Figure 1A:
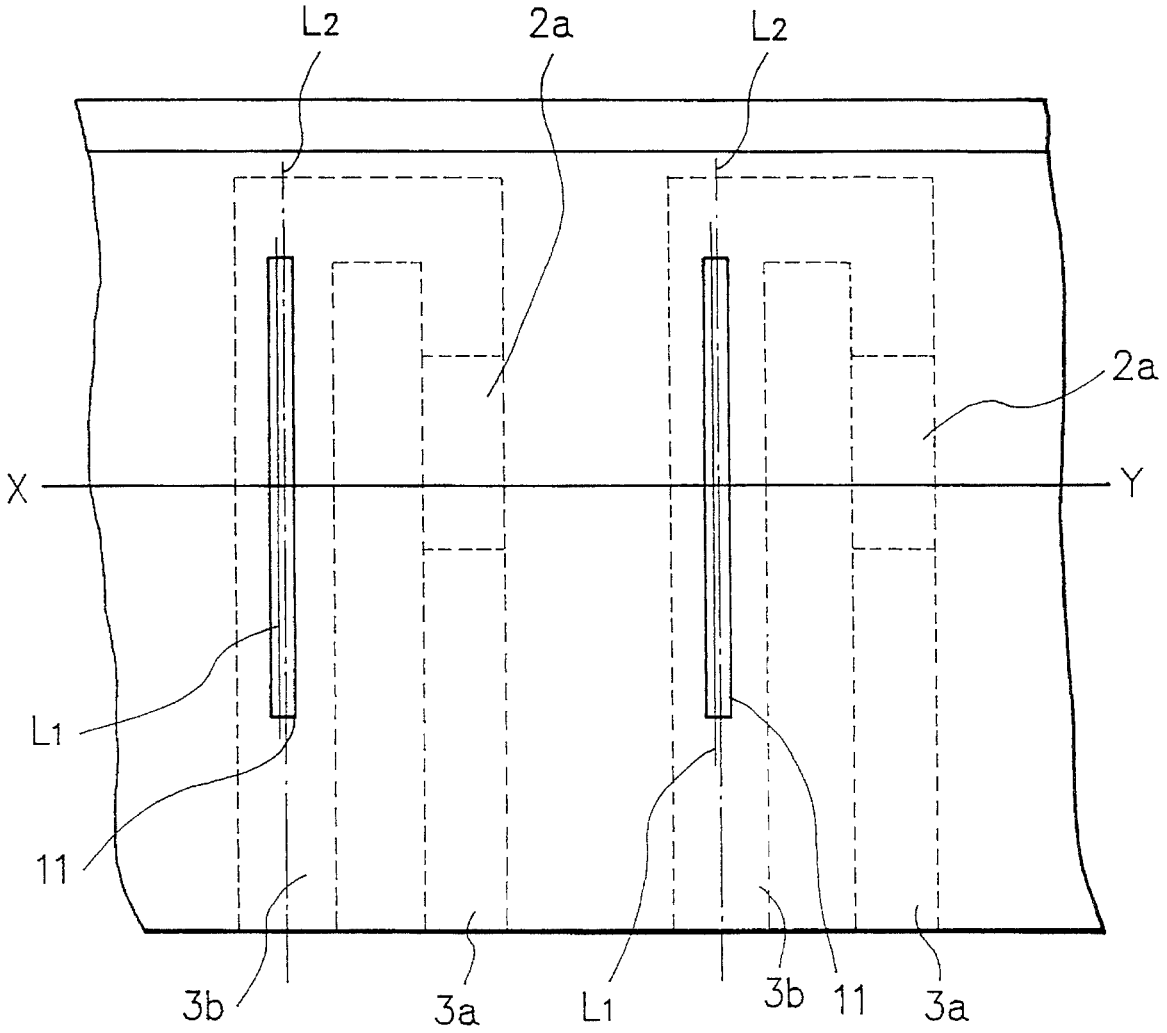
FIG. 1(*a*) is a schematic plan view illustrating the configuration of an example of a substrate for ink jet recording head according to the present invention.

The present inventors have made extensive studies in order to overcome the foregoing technical subjects (a) to (d) in the conventional ink jet recording head, which particularly concern the adhesion between the ink jet recording head substrate and the nozzle-forming walls, and in order to attain the above objects through experiments which will be later described.

As a result, the present inventors have obtained knowledges that a substrate for ink jet head can be firmly contacted with nozzle-forming walls with an improved adhesion by chipping predetermined portions of the second protective layer as a constituent of the substrate for ink jet head to form a plurality of recessed portions at the second protective layer and treating the recessed portions with a specific silane coupling agent or a mixture of said silane coupling agent and a specific inorganic compound.

These knowledges have been concluded based on the following findings obtained through the experiments conducted by the present inventors.

That is, it has been a technical common sense in the field of ink jet recording head that to partially cut off the second protective layer as a constituent of the substrate for ink jet head, which serves to protect the electrode and the heat generating resistor, will result in damaging the electrode or/and the heat generating resistor. Consequently nobody has ever tried to partially cut off the second protective layer. Disregarding this technical common sense, the present inventors have tried to chip a plurality of given portions of the second protective layer each situated above the electrode or the heat generating resistor to form a plurality of recessed portions at the second protective layer while leaving opposite portions of the second protective layer which cover the stepped portions of the first protective layer under which the electrode or the heat generating resistor is positioned. As a result, it has been found that such recessed portion of the second protective layer establishes a region which serves to relax a stress between the first and second protective layers and to effectively prevent occurrence of a removal between the two layers.

The present inventors then have treated the recessed portion of the second protective layer with a specific silane coupling agent. As a result, it has been found that the nozzle-forming walls can be firmly contacted with the first and second protective layers with an improved adhesion, whereby a desirable adhesion between the substrate for ink jet recording head and the nozzle-forming walls can be achieved.

Separately, the present inventors have treated the recessed portions of the second protective layer with a mixture of a specific silane coupling agent and a specific inorganic compound. As a result, it has been found that the adhesion between the substrate for ink jet recording head and the nozzle-forming walls can be further improved. The present inventors have obtained findings in this case that the specific inorganic compound serves as a filler for a poor pressure-resistant portion of the first protective layer whereby certainly preventing penetration of ink, and since a reliable adhesion is ensured between the substrate for ink jet recording head and the nozzle-forming walls, the electrode and the heat generating resistor are hardly deteriorated even upon driving at a high voltage.

The present invention has been accomplished based on these findings. The present invention includes an improved ink jet recording head, an ink jet recording apparatus provided with said ink jet recording head, and a process for producing said ink jet recording head.

The ink jet recording head according to the present invention includes a substrate for ink jet recording head and a nozzle structural body provided with a plurality of nozzle-forming walls which is disposed over said substrate for ink jet recording head, said substrate for ink jet recording head comprising a base member; a heat generating resistor capable of generating, upon energization, thermal energy to be utilized for discharging ink; a pair of electrodes electrically connected to said heat Generating resistor; a first protective layer; and a second protective layer, wherein said heat generating resistor and said pair of electrodes are arranged on said base member, and said first protective layer and said second protective layer are disposed in this order over said heat generating resistor and said pair of electrodes, characterized in that a plurality of given portions of said second protective layer each situated at a position where said nozzle structural body is joined through one of said nozzle-forming walls to said substrate for ink jet recording head are removed while leaving opposite stepped portions of said second protective layer situated above said pair of electrodes.

The ink jet recording apparatus according to the present invention comprises an ink jet recording head and means for applying a driving signal to said ink jet recording head; said ink jet recording head comprising a substrate and a nozzle structural body provided with a plurality of nozzle-forming walls which is disposed over said substrate; said substrate comprising a base member, a heat generating resistor capable of generating, upon energization, thermal energy to be utilized for discharging ink, a pair of electrodes electrically connected to said heat generating resistor, a first protective layer and a second protective layer, wherein said heat generating resistor and said pair of electrodes are arranged on said base member, and said first protective layer and said second protective layer are disposed in this order over said heat generating resistor and said pair of electrodes, characterized in that a plurality of given portions of said second protective layer each situated at a position where said nozzle structural body is joined through one of said nozzle-forming walls to said substrate are removed while leaving opposite stepped portions of said second protective layer situated above said pair of electrodes.

The process for producing an ink jet recording head according to the present invention comprises the steps of (i) forming a heat generating resistor and a pair of electrodes electrically connected to said heat generating resistor on a base member, (ii) forming a first protective layer and a second protective layer in this order over said heat generating resistor and said pair of electrodes formed on said base member to thereby obtain a substrate for ink jet recording head, and (iii) arranging a nozzle structural body having a plurality of nozzle-forming walls on said substrate, characterized in that said process further comprises a step of (iv) spacedly removing said second protective layer situated at each position where said nozzle structural body is joined through one of said nozzle-forming walls to said substrate while leaving opposite stepped portions of said second protective layer situated above said pair of electrodes to thereby spacedly establish a plurality of recessed portions at said second protective layer.

In the following, description will be made of the experiments through which the present inventors obtained the foregoing findings.

EXPERIMENT A

In this experiment, studies were made of the interrelation between a given region of the second protective layer to be etched and a damage possibly occurred at the first protective layer at the time of preparing a substrate for ink jet head (the substrate for ink jet head will be hereinafter called simply "substrate").

There were prepared a plurality of substrate samples (that is, substrate samples A-1 to A-18) each having the configuration shown in FIGS. 1(*a*) and 1(*b*) in the manner as will be described below.

Figure 1B:
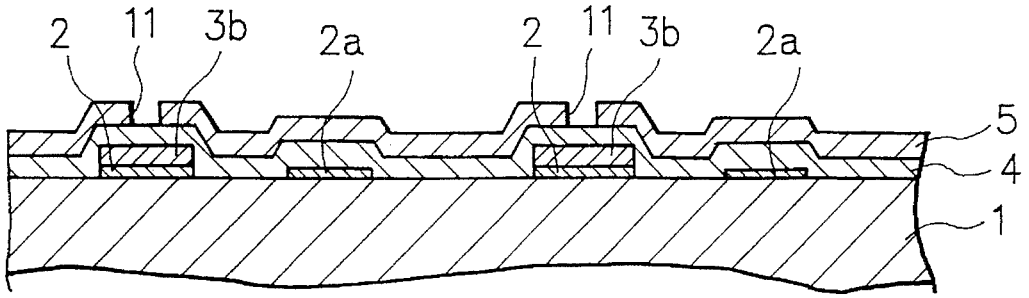

In FIGS. 1(*a*) and 1(*b*), reference numeral 1 indicates a base member, and each of reference numerals 2 and 2*a* indicates a heat generating resistor layer with a given pattern formed on the base member 1, wherein the heat generating resistor layer 2*a* serves as a heat generating resistor. Each of reference numerals 3*a* and 3*b* indicates an electrode layer, wherein the electrode layer 3*a* serves as a selective electrode and the electrode layer 3*b* serves as a common electrode. Reference numeral 4 indicates a first protective layer disposed so as to cover the heat generating resistor layers 2 and 2*a* and the electrodes 3*a* and 3*b*. Reference numeral 5 indicates a second protective layer formed on the first protective layer 4. Reference numeral 11 indicates a recessed portion formed at the second protective layer 5.

PREPARATION OF SUBSTRATE SAMPLES A-1 to A-6

Preparation of substrate sample A-1:

There was firstly provided a single crystalline Si wafer of 5 inches in diameter (produced by Wacker Company) having a 2.5 μm thick thermal oxide layer formed on the surface thereof as the base member 1.

A 0.1 μm thick $HfB_2$ layer to be the heat generating resistor 2 and the heat generating resistor 2*a* was formed on the thermal oxide layer by sputtering a $HfB_2$ target in a sputtering apparatus (trademark name: SPF-730H, produced by Nichiden Aneruba Kabushiki Kaisha). Successively, on the $HfB_2$ layer was formed a 0.6 μm thick A1 layer to be the electrodes 3*a* and 3*b* by sputtering an A1 target in the above sputtering apparatus.

The resultant was introduced into a coating apparatus (trademark name: CDS630, produced by Canon Kabushiki Kaisha), wherein a resist of OFPR-800 (produced by Tokyoohka Kabushiki Kaisha) was applied to form a resist layer thereon. The resist layer formed on the base member was subjected to exposure treatment using a light filter (trademark name: PLA-500FA, produced by Canon Kabushiki Kaisha) whereby predetermined portions of the resist layer were exposed to light. The resist later thus treated on the base member was patterned by subjecting it to development treatment using a developing apparatus.

The work in process thus obtained was subjected to etching treatment using an etching solution of C-6 (produced by Tokyoohka Kabushiki Kaisha), wherein the A1 layer was etched utilizing the patterned resist layer as a mask, followed by etching the $HfB_2$ layer with the use of an etching solution composed of HF and $HNO_3$. By this, the heat generating resistors 2*a*, the selective electrodes 3*a* and the common electrodes 3*b* were formed.

Then, the resultant was introduced into the sputtering apparatus (trademark name: SPF-730H, produced by Nichiden Aneruba Kabushiki Kaisha), wherein a 1.0 μm thick $SiO_2$ layer as the first protective layer 4 was formed thereon by sputtering a target composed of $SiO_2$, followed by forming a 0.5 μm thick Ta layer as the second protective layer 5 on the first protective layer 4 by sputtering a target composed of Ta.

On the second protective layer 5 thus formed, there was formed a resist layer by applying a resist of OFPR-800 (produced by Tokyoohka Kabushiki Kaisha) using the coating apparatus (trademark name: CDS630, produced by Canon Kabushiki Kaisha). The resist layer formed on the second protective layer 5 was subjected to exposure treatment using the light filter (trademark name: PLA-500FA, produced by Canon Kabushiki Kaisha) whereby predetermined portions of the resist layer were exposed to light. The resist later thus treated was patterned by subjecting it to development treatment using a developing apparatus. The resultant thus obtained was subjected to dry etching treatment using an dry etching apparatus (trademark name: DEA 506, produced by Nichiden Aneruba Kabushiki Kaisha), wherein the patterned resist layer was utilized as a mask, whereby a plurality of recessed portions 11 each having a rectangular shape of 150 μm at the second protective layer 5 as shown in FIGS. 1(*a*) and 1(*b*).

The dry etching conditions employed in this case were as follows:

etching gas used: $CF_4$,
flow rate of the etching gas: 70 sccm,
gas pressure: 4.0 Pa,
electric power applied: 1.0 KW, and
etching speed: 400 Å/minute.

Thereafter, in order to make it possible to apply a voltage to the electrodes 3*a* and 3*b* and the heat generating resistors 2*a*, there were formed a plurality of through-holes at the first and second protective layers such that they lead to the electrodes by means of the conventional photolithography technique. Thus, there was obtained a substrate for ink jet recording head. The substrate was cut to obtain a plurality of substrate units. Of these substrate units, one substrate unit was affixed onto a support comprising SUS 304 (JIS), to which a print circuit board (hereinafter referred to as PCB) was then affixed such that a voltage can be applied to the electrodes and the heat generating resistors. Thereafter, the throughholes and the PBC were electrically connected with the use of an Ag paste by means of the wire bonding technique.

Thus, there was obtained a substrate sample A-1.

In this way, there were prepared 100 substrate samples A-1.

Now, the width of each of the common electrodes 3*b* and the width of each of the recessed portions 11 formed at the second protective layer 5 of this substrate sample A-1 are shown in Table 1.

Additionally, this substrate sample A-1 is provided with 128 heat generating resistors 2*a*, wherein each of the heat generating resistors 2*a* is of 25 μm in width and 100 μm in length, each of the selective electrodes 3*a* is of 25 μm in width, and the interval between the adjacent heat generating resistors is 70.5 μm. Preparation of substrate samples A-2 to A-6:

The procedures of preparing the substrate sample A-1 were repeated, except that the width of each of the common electrodes 3*b* and the width of each of the recessed portions 11 formed at the second protective layer 5 were changed as shown in Table 1 in each case. Thus, there were obtained substrate samples A-2 to A-6. As well as in the case of the substrate sample A-1, as for each of the substrate samples A-2 to A-6, there were prepared 100 samples.

PREPARATION OF SUBSTRATE SAMPLES A-7 TO A-12

Preparation of substrate sample A-7:

The procedures of preparing the substrate sample A-1 were repeated, except that the constituent of the first protective layer 4 was changed to $Si_3N_4$, the constituent of the second protective layer 5 was changed to Cr, and the dry etching treatment for the second protective layer was conducted under the following conditions:

etching gas used: $CCl_4$,
flow rate of the etching gas: 40 sccm,
gas pressure: 2.0 Pa,
electric power applied: 1.0 KW, and
etching speed: 300 Å/minute.

In this way, there were prepared 100 substrate samples A-7.

Preparation of substrate samples A-8 to A-12:

The procedures of preparing the substrate sample A-7 were repeated, except that the width of each of the common electrodes 3*b* and the width of each of the recessed portions 11 formed at the second protective layer 5 were changed as shown in Table 2 in each case. Thus, there were obtained substrate samples A-8 to A-12. As well as in the case of the substrate sample A-7, as for each of the substrate samples A-8 to A-12, there were prepared 100 samples.

PREPARATION OF SUBSTRATE SAMPLES A-13 TO A-18

Preparation of substrate sample A-13:

The procedures of preparing the substrate sample A-1 were repeated, except that the constituent of the first protective layer 4 was changed to $Ta_2O_5$, the constituent of the second protective layer 5 was changed to Pt, and the dry etching treatment for the second protective layer was conducted under the following conditions:

etching gas used: $CF_4$,
flow rate of the etching gas: 50 sccm,
gas pressure: 3.0 Pa,
electric power applied: 1.0 KW, and
etching speed: 200 Å/minute.

In this way, there were prepared 100 substrate samples A-13.

Preparation of substrate samples A-14 to A-18:

The procedures of preparing the substrate sample A-13 were repeated, except that the width of each of the common electrodes 3*b* and the width of each of the recessed portions 11 formed at the second protective layer 5 were changed as shown in Table 3 in each case. Thus, there were obtained substrate samples A-14 to A-18. As well as in the case of the substrate sample A-13, as for each of the substrate samples A-14 to A-18, there were prepared 100 samples.

EVALUATION

Each substrate sample was evaluated in the following manner.

That is, the substrate sample was immersed in ink of the following composition in a vessel.

The composition of the ink:

diethylene glycol: 20 parts by weight, dye (C.I. Food Black 2) : 3 parts by weight, and water: 67 parts by weight.

Then, a counter electrode comprising a Pt plate of 20 mm×20 mm in size was placed in the ink, and a given voltage was applied between the counter electrode, and the electrodes and the heat generating resistors of the substrate sample through the PCB, wherein the value of an electric current flown was measured using a digital electrometer (trademark name: 4140 A, produced by YHP Company). The measurement in this case was conducted under the following conditions:

voltage applied: +20 V to −20 V for 30 seconds, and
rate of change in voltage: 0.5 V/sec.

On the basis of the measured results, each substrate sample was evaluated based on the following criteria. That is, the case where the current value was $10^{-8}$ A or more is inferior, and the case where the current value was less than $10^{-8}$ A is good. This evaluation criteria is based on the facts that electric erosion is occurred at the electrode or/and the heat generating resistor wherein ink is chemicall reacted with them when the value of an electric current flown exceeds $10^{-8}$ A and that such problems are not occurred when the value of an electric current flown is less than $10^{-8}$ A.

The evaluated results obtained are collectively shown in Tables 1 to 3.

Based on the results shown in Tables 1 to 3, it has been found that an electric current is substantially not flown into the ink even when given portions of the second protective layer each capable of serving for the contact with a nozzle-forming wall are recessed such that the first protective layer is exposed through each of the recessed portions, as long as the stepped portions of the electrodes and the heat generating resistors are covered by the second protective layer notwithstanding the kind of the constituent of the first protective layer and that of the second protective layer. Particularly, it has been found that the electrodes and heat generating resistors are not electrically eroded and the ink is not chemically reacted with them as along as the stepped portions of the electrodes and heat generating resistors are covered by the second protective layer.

EXPERIMENT B

In this experiment, studies were made of the possibility of improving an adhesion between the nozzle-forming walls and the substrate for ink jet recording head.

In the following, the nozzle formation was conducted in accordance with method I described in FIGS. 4(*a*) through 4(*c*) or method II described in FIGS. 5(*a*) through 5(*e*) which will be later described.

PREPARATION OF RECORDING HEAD SAMPLE A

There were prepared six kinds of recording head samples A-1 to A-6 in the following manner.

Preparation of recording head sample A-1:

The procedures of preparing the substrate sample A-1 described in Experiment A were repeated, except that the width and length of each of the heat generating resistors, the interval between the adjacent heat generating resistors, the number of the heat generating resistors, the width of each of the electrodes, and the width of each of the recessed portions formed at the second protective layer were changed to those shown in the column of substrate sample No. 1 of Table 4, to thereby a substrate for ink jet recording head.

At the substrate thus obtained, there were formed a plurality of nozzles of the constitution shown in the column of nozzle constitution No. 1 of Table 5 in accordance with the method I. In this way, there were prepared eight recording head samples A-1.

Preparation of recording head samples A-2 to A-6:

The procedures of preparing the recording head sample A-1 were repeated, except that the constitution of the substrate was changed to one of substrate sample Nos. 2 to 6 shown in Table 4 and the constitution of the nozzles was changed to one of nozzle constitution Nos. 2 to 6 shown in Table 5 in each case. Thus, there were obtained recording head samples A-2 to A-6. As for each of the recording head samples A-2 to A-6, eight samples were prepared.

PREPARATION OF COMPARATIVE RECORDING HEAD SAMPLE A

The procedures of preparing the recording head sample A-1 were repeated, except that no recessed portion was formed at the second protective layer, to thereby obtain a comparative recording head sample A. In this way, there were prepared eight comparative recording head samples A.

PREPARATION OF RECORDING HEAD SAMPLE B

There were prepared six kinds of recording head samples B-1 to B-6.

In each case, the procedures of preparing the substrate sample A-7 described in Experiment A were repeated, except that the width and length of each of the heat generating resistors, the interval between the adjacent heat generating resistors, the number of the heat generating resistors, the width of each of the electrodes, and the width of each of the recessed portions formed at the second protective layer were changed to those shown in one of substrate sample Nos. 1 to 6 of Table 4, to thereby a substrate for ink jet recording head. At the substrate thus obtained, there were formed a plurality of nozzles in the same manner as in the case of preparing the recording head sample A-1. Thus, there were obtained recording head samples B-1 to B-6. As for each of the recording head samples B-1 to B-6, eight samples were prepared.

PREPARATION OF COMPARATIVE RECORDING HEAD SAMPLE B

The procedures of preparing the recording head sample B-1 were repeated, except that no recessed portion was formed at the second protective layer, to thereby obtain a comparative recording head sample B. In this way, there were prepared eight comparative recording head samples B.

PREPARATION OF RECORDING HEAD SAMPLE C

There were prepared six kinds of recording head samples C-1 to C-6.

In each case, the procedures of preparing the substrate sample A-13 described in Experiment A were repeated, except that the width and length of each of the heat generating resistors, the interval between the adjacent heat generating resistors, the number of the heat generating resistors, the width of each of the electrodes, and the width of each of the recessed portions formed at the second protective layer were changed to those shown in one of substrate sample Nos. 1 to 6 of Table 4, to thereby a substrate for ink jet recording head. At the substrate thus obtained, there were formed a plurality of nozzles in the same manner as in the case of preparing the recording head sample A-1. Thus, there were obtained recording head samples C-1 to C-6. As for each of the recording head samples C-1 to C-6, eight samples were prepared.

PREPARATION OF COMPARATIVE RECORDING HEAD SAMPLE C

The procedures of preparing the recording head sample C-1 were repeated, except that no recessed portion was formed at the second protective layer, to thereby obtain a comparative recording head sample C. In this way, there were prepared eight comparative recording head samples C.

PREPARATION OF RECORDING HEAD SAMPLES A, B AND C

Preparation of recording head samples a-1 to a-6:

In each case, the procedures of preparing one of the recording head sample A-1 to A-6 were repeated, except the nozzle formation was conducted in accordance with the method II. Thus, there were obtained recording head samples a-1 to a-6. As for each of the recording head samples a-1 to a-6, eight samples were prepared.

Preparation of recording head samples b-1 to b-6:

In each case, the procedures of preparing one of the recording head sample B-1 to B-6 were repeated, except the nozzle formation was conducted in accordance with the method II. Thus, there were obtained recording head samples b-1 to b-6. As for each of the recording head samples b-1 to b-6, eight samples were prepared.

Preparation of recording head samples c-1 to c-6:

In each case, the procedures of preparing one of the recording head sample C-1 to C-6 were repeated, except the nozzle formation was conducted in accordance with the method II. Thus, there were obtained recording head samples c-1 to c-6. As for each of the recording head samples c-1 to c-6, eight samples were prepared.

Preparation of comparative recording head sample a:

The procedures of preparing the comparative recording head sample A were repeated, except the nozzle formation was conducted in accordance with the method II, to thereby obtain a comparative obtained recording head sample a. In this way, there were prepared eight comparative recording head samples a.

Preparation of comparative recording head sample b:

The procedures of preparing the comparative recording head sample B were repeated, except the nozzle formation was conducted in accordance with the method II, to thereby obtain a comparative obtained recording head sample b. In this way, there were prepared eight comparative recording head samples b.

Preparation of comparative recording head sample c:

The procedures of preparing the comparative recording head sample C were repeated, except the nozzle formation was conducted in accordance with the method II, to thereby obtain a comparative obtained recording head sample c. In this way, there were prepared eight comparative recording head samples c.

In the following, description will be made of each of the nozzle forming methods, that is, the method I and the method II.

THE METHOD I

Figure 4A:
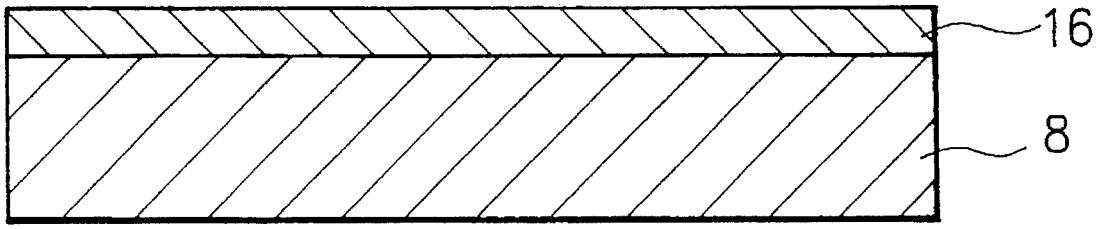
FIGS. 4(*a*) through 4(*c*) are schematic views stepwisely illustrating a manner of preparing a nozzle-forming structural member in the present invention.
Figure 4B:
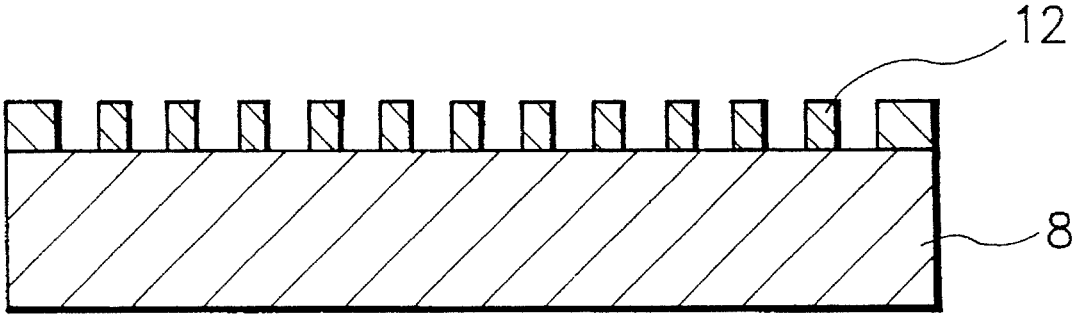
Figure 4C:
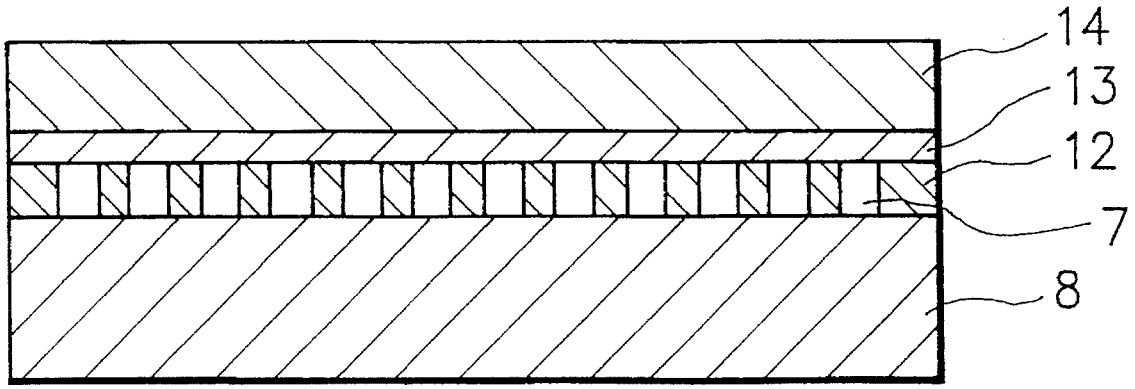
Figure 5A:
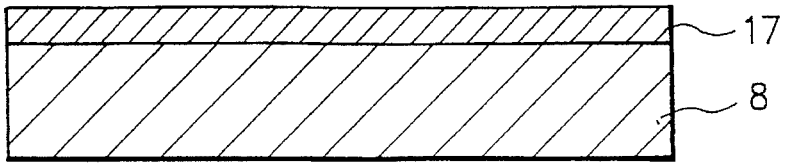
FIGS. 5(*a*) through 5(*e*) are schematic views stepwisely illustrating other manner of preparing a nozzle-forming structural member in the present invention.
Figure 5B:
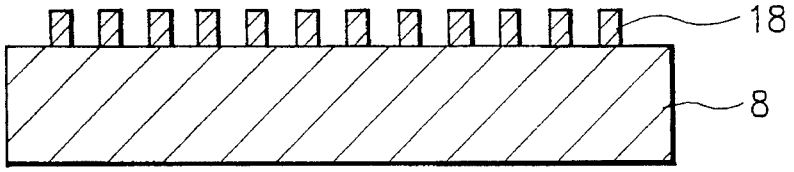
Figure 5C:
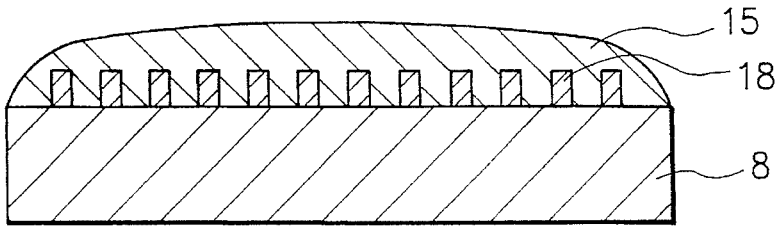
Figure 5D:
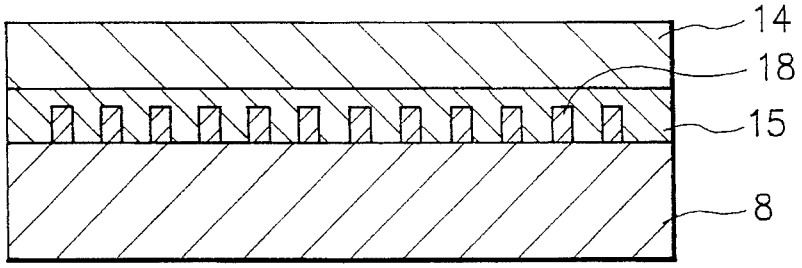
Figure 5E:
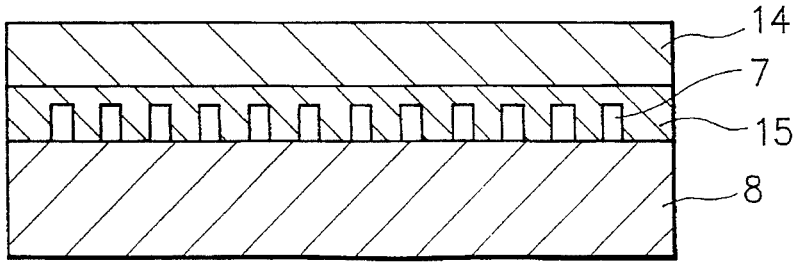
Figure 6A:
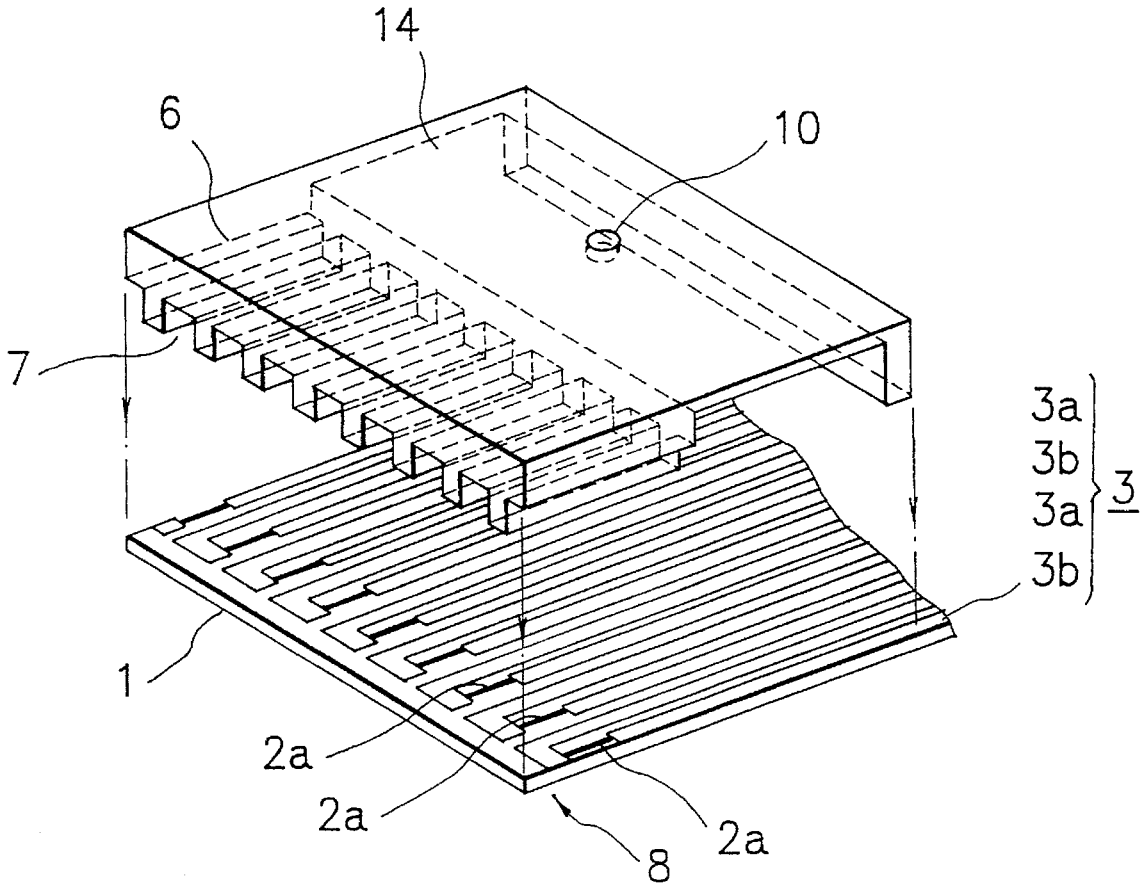
FIG. 6(a) (PRIOR ART)
FIG. 6(*a*) is a schematic perspective view illustrating the constitution of a conventional ink jet recording head.
Figure 6B:
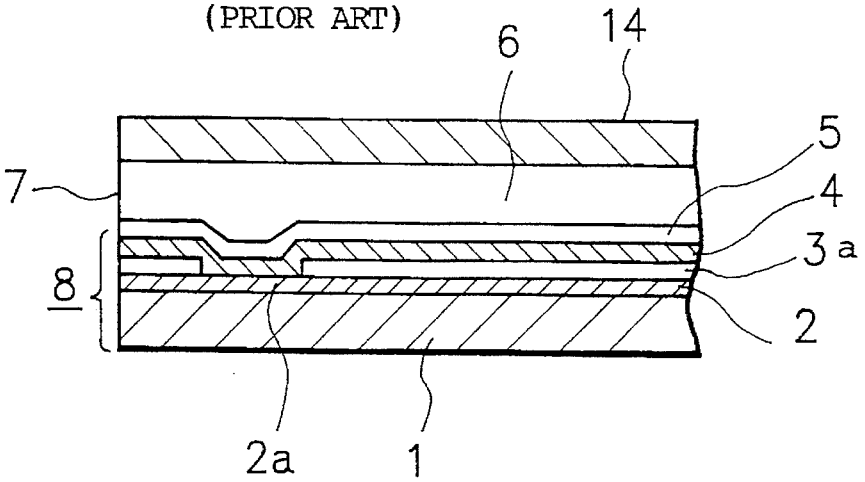
FIG. 6(b) (PRIOR ART)

This method I is schematically illustrated in FIGS. 4(*a*) through 4(*c*).

The substrate 8 for ink jet recording head which is provided with heat generating resistors, electrodes and first and second protective layers (which has been prepared in accordance with the manner described in the foregoing Experiment A) is cleaned with pure water by means of the ultrasonic cleaning technique, followed by drying using vapor of isopropyl alcohol.

On the substrate 8 thus cleaned, a negative dry film 16 is laminated using a laminater (trademark name: A-500R, produced by Akebono Kabushiki Kaisha)(see, FIG. 4(*a*)).

In this case, for providing a nozzle height of 35 μm, there is used a negative dry film (trademark name: ORDYL SX-335, produced by Tokyo Ohka Kabushiki Kaisha), and for providing a nozzle height of 30 μm, there is used a negative dry film (trademark name: ORDYL SX-330, produced by Tokyo Ohka Kabushiki Kaisha).

The film lamination in this case is conducted under the following conditions:

heating roller temperature: 110 ° C.,
lamination speed: 0.15 m/minute, and
lamination roller pressure: 4.5 Kg/cm$^2$.

The substrate 8 having the layered dry film thereon is introduced into an oven, wherein it is heated at 90° C. for 20 minutes. Then, it is subjected to exposure treatment at 900 mJ/cm$^2$ using a mask aligner (trademark name: MPA-500FA, produced by Canon Kabushiki Kaisha), followed by subjecting the resultant to heat treatment at 90° C. for 10 minutes in an oven. Thereafter, the substrate is subjected to development treatment using a developing apparatus (trademark name: CDS-630, produced by Canon Kabushiki Kaisha) under the following conditions:

jetting pressure of the developing liquid: 0.5 Kg/cm$^2$,
developing period: 2 minutes,
developing liquid: trichloroethane, and treatment temperature: 25° C.

After the development treatment, the resultant is introduced into an oven, wherein it is dried at 90° C. for 10 minutes. Thus, there is obtained a substrate provided with a plurality of nozzle-forming walls 12 for ink jet recording head having the configuration shown in FIG. 4(*b*).

A top plate is prepared. That is, a heat resisting glass plate (Pyrex glass plate) 14 provided with an ink supply port is provided, and on the face thereof to be served for contact, a negative dry film 13 (trademark name : ORDEAL SY-355, produced by Tokyo Ohka Kabushiki Kaisha) is laminated under the following conditions:

heating roller temperature: 110° C.,
lamination speed: 0.15 m/minute, and
lamination roller pressure: 4.5 Kg/cm$^2$.

Then, the resultant is subjected to exposure treatment at 500 mJ/cm$^2$ using a mask aligner (trademark name: PLA-500FA, produced by Canon Kabushiki Kaisha), followed by subjecting to heat treatment at 90° C. for 10 minutes in an oven. The resultant is then subjected to development treatment using a developing apparatus (trademark name: CDS-630, produced by Canon Kabushiki Kaisha) under the following conditions:

jetting pressure of the developing liquid: 0.5 Kg/cm$^2$,
developing period: 1 minute,
developing liquid: trichloroethane, and
treatment temperature: 25° C.

After the development treatment, the resultant is introduced into an oven, wherein it is dried at 150° C. for 60 minutes.

To the surface of the negative dry film 13 of the top plate, ultraviolet rays are irradiated at 30 J/cm$^2$ using a ultraviolet ray curing apparatus (produced by Ushio Kabushiki Kaisha).

The top plate thus obtained is joined to the foregoing substrate provided with the nozzle-forming walls using a joining apparatus under the following conditions:

joining temperature: 90° C.,
joining pressure: 6.0 Kg/cm$^2$, and
joining period: 5 minutes.

The resultant is introduced into an oven, wherein it is subjected to curing treatment at 150° C. for 60 minutes, followed by irradiating ultraviolet rays at 100 J/cm$^2$ using the ultraviolet ray curing apparatus.

The head product obtained in the above is cut through the portion thereof (including the substrate, the nozzle-forming walls, the negative dry film, and the pyrex glass plate) capable of providing discharging outlets 7, whereby forming discharging outlets 7. Thus, there is obtained an ink jet recording head of the configuration shown in FIGS. 2(*a*) through 2(*c*).

THE METHOD II

This method II is schematically illustrated in FIGS. 5(*a*) through 5(*e*).

The substrate 8 for ink jet recording head which is provided with heat generating resistors, electrodes and first and second protective layers (which has been prepared in accordance with the manner described in the foregoing Experiment A) is cleaned with pure water by means of the ultrasonic cleaning technique, followed by drying using vapor of isopropyl alcohol.

On the substrate 8 thus cleaned, a positive resist 17 (trademark name: PMER P-AR900, produced by Tokyo Ohka Kabushiki Kaisha) is applied by way of spin coating process using a resist coating apparatus (trademark name: CDS-630, produced by Canon Kabushiki Kaisha) as shown in FIG. 5(*a*).

The substrate 8 having the layered resist film 17 thereon is introduced into an oven, wherein it is subjected to curing treatment at 90° C. for 60 minutes. Then, it is subjected to exposure treatment at 2500 mJ/cm$^2$ using the mask aligner (trademark name: MPA-500FA, produced by Canon Kabushiki Kaisha), followed by subjecting the resultant to development treatment using the developing apparatus (trademark name: CDS-630, produced by Canon Kabushiki Kaisha) under the following conditions:

developing liquid used: PMER developing liquid (produced by Tokyo Ohka Kabushiki Kaisha),
developing liquid temperature: 25° C., and
development period: 3 minutes.

After the development treatment, the resultant is subjected to curing treatment at 70° C. for 180 minutes in an oven. Thus, there is formed a layered positive resist film 18 at the position where a plurality of ink pathways are to be provided as shown in FIG. 5(*b*).

Then, a bisphenol epoxy resin as a resin 15 (hereinafter referred to as casting agent) capable of forming nozzle-forming walls and a ceiling is applied so as to cover the positive resist film 18 formed at the position where the ink pathways are to be provided as shown in FIG. 5(*c*). A heat resisting glass plate (Pyrex glass plate) provided with an ink supply port is then disposed thereon. Thereafter, in order to remove useless part of the casting agent, a film mask is positioned on the heat resisting glass plate, and ultraviolet rays are irradiated at 30 J/cm$^2$ using the ultraviolet ray curing apparatus (produced by Ushio Kabushiki Kaisha). Then, trichloroethane is jetted to remove non-exposure part of the casting agent, followed by subjecting the resultant to curing treatment at 120° C. for 30 minutes in an oven.

The head product obtained in the above is cut through the portion thereof (including the substrate, the positive resist positioned in the nozzle patways, the nozzle-forming walls, the casting agent forming the ceiling, and the heat resisting glass plate) capable of providing discharging outlets 7, whereby forming discharging outlets 7 as shown in FIG. 5(*d*).

Finally, the resultant is introduced into a vessel containing a 2% NaOH aqueous solution, wherein it is cleaned by means of a ultrasonic cleaning device to remove the positive resist positioned in the nozzle pathways.

Figure 3A:
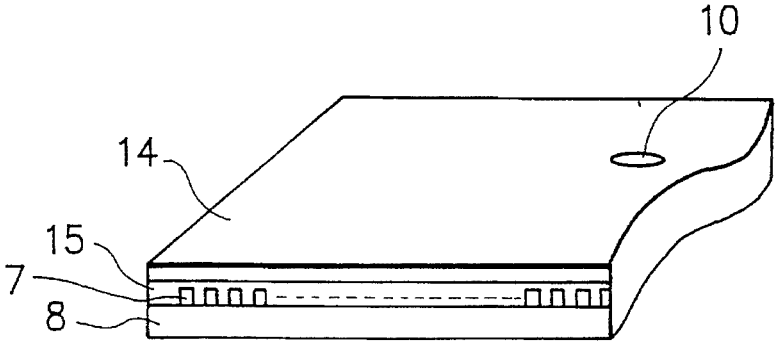
FIG. 3(*a*) is a schematic slant view illustrating the configuration of other example of an ink jet recording head according to the present invention.
Figure 3B:
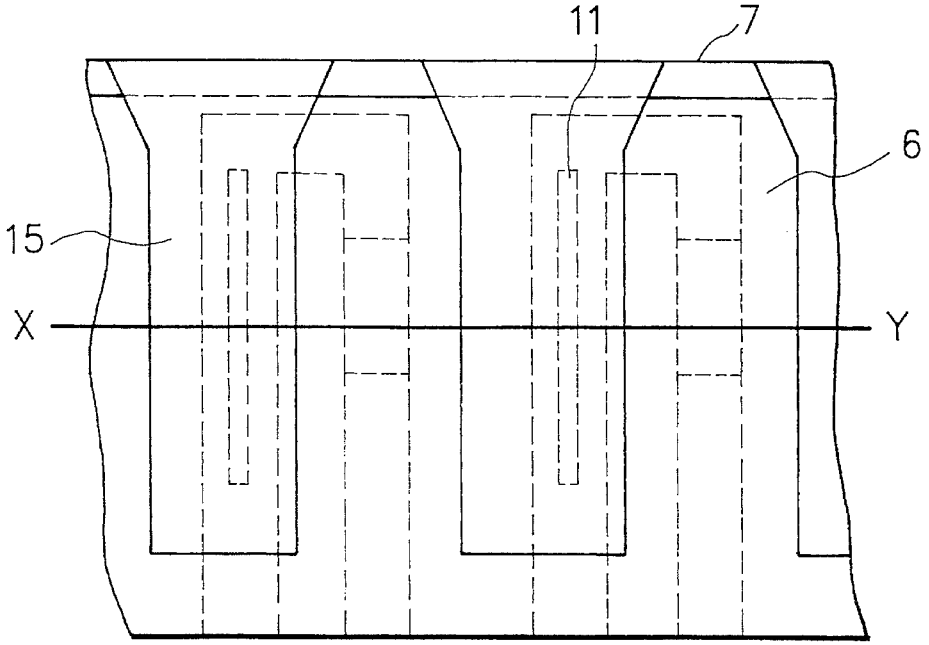
Figure 3C:
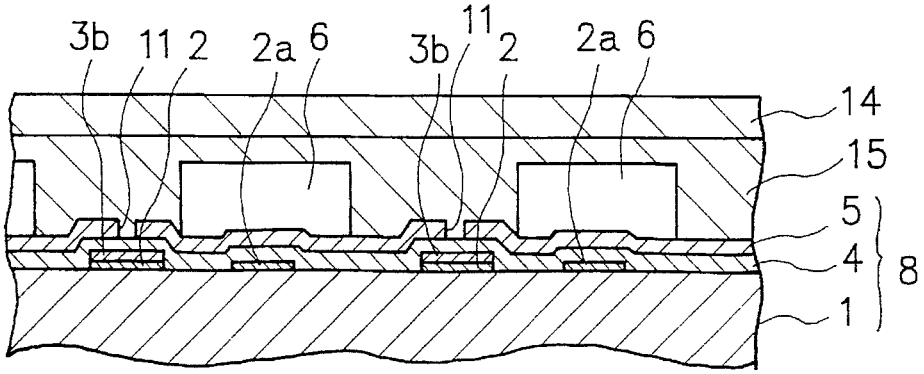

Thus, there is obtained an ink jet recording head of the configuration shown in FIGS. 3(*a*) through 3(*c*).

EVALUATION

As for each of the foregoing recording head samples and each of the foregoing comparative recording head samples, evaluation was conducted of the adhesion between the substrate and the nozzle-forming walls by way of the following pressure cooker test (PCT) and ink immersion endurance test.

PRESSURE COOKER TEST (PCT) IN INK

Each recording head sample was placed in a petri dish containing given ink. The petri dish was set to a pressure cooker test machine (trademark name: PC-364PII, produced by Hirayama Seisakusho Kabushiki Kaisha), wherein the recording head sample was evaluated under the following PCT conditions:

atmospheric pressure: 2 mmHg,
temperature: 121° C., and
evaluation point: after 10 hours, after 20 hours, after 30 hours, after 50 hours, and after 80 hours.

As the ink, there were used the below-described inks A and B. The test was conducted as for each of these inks.

INK IMMERSION ENDURANCE TEST

Each recording head sample was placed in a petri dish containing given ink, and the petri dish was introduced into a thermoregulator, wherein the recording head sample was evaluated after a month lapsed, after three months lapsed, and after six months lapsed.

INK USED:

Ink A:
diethylene glycol: 20 parts by weight
dye (C.I. Food Black 2) : 3 parts by weight
water: 67 parts by weight
PH value: 6.5

Ink B:
diethylene glycol: 12 parts by weight
urea: 7 parts by weight
dye (C.I. Food Black 2) : 4 parts by weight
water: 67 parts by weight
PH value: 10.5

In each of the above two tests, the evaluation was conducted by optical observation using a metallographic microscope (magnification: ×100) (trademark name: UM-3, produced by Nikon Kabushiki Kaisha) on the basis of the following criteria:

○: the case wherein neither nozzle removal nor infringe pattern is observed,
Δ: the case wherein slight nozzle removal or/and slight infringe pattern are observed, and
X: the case wherein apparent nozzle removal and apparent infringe pattern are observed.

The evaluated results in the pressure cooker test and the ink immersion endurance test when the ink A was used are collectively shown in Tables 6 to 11.

The evaluated results in the pressure cooker test and the ink immersion endurance test when the ink B was used are collectively shown in Tables 12 to 17.

Based on the results shown in Tables 6 to 17, the following findings have been obtained.

That is, (i) when given portions of the second protective layer each capable of serving for the contact with a nozzle-forming wall are recessed such that the first protective layer is exposed through each of the recessed portions, the adhesion between the substrate for ink jet recording head and the nozzle-forming walls is maintained in a desirable state without being deteriorated even when the recording head is affected by a high pressure or is stored in ink over a long period of time;

(ii) when given portions of the second protective layer each capable of serving for the contact with a nozzle-forming wall are recessed such that the first protective layer is exposed through each of the recessed portion and the nozzle-forming walls are constituted by an organic material, the adhesion between the substrate for ink jet recording head and the nozzle-forming walls is improved without depending upon the nozzle-forming method; and (iii) in the case of the recording head in which given portions of the second protective layer each capable of serving for the contact with one of the nozzle-forming walls are recessed such that the first protective layer is exposed through each of the recessed portions and which is provided with a number of nozzles being arranged at a relatively high density, the adhesion between the substrate and the nozzle-forming walls is not always satisfactory in the case of using alkaline ink as the recording liquid.

These findings reveal that in the case of an ink jet recording head which takes a severer constitution and which is used under severer conditions, there are some subjects to be further improved.

EXPERIMENT C

In this experiment, studies were made of the possibility of improving the adhesion between the nozzle-forming walls and the substrate for ink jet recording head by using a silane coupling agent.

The subject recording head which was intended to make an improvement therefor in this experiment is one that has an elongated substrate for ink jet recording head with such a configuration that a greater number of heat generating resistors are arranged at a high density, wherein the junction face between the substrate and the nozzle-forming walls is very possibly deteriorated.

PREPARATION OF SILANE MATERIAL-APPLIED RECORDING HEAD SAMPLES A-1 TO A-18:

There was used the substrate sample No. 6 shown in Table 4, in which the first protective layer is composed of $SiO_2$ and the second protective layer is composed of Ta.

The procedures of preparing the recording head sample A-1 in Experiment B were repeated, except that one of the silane coupling agents Nos. 1 to 18 shown in Table 18 was applied to each of the recessed portions formed at the second protective layer of the substrate sample No. 6 and that the nozzles were formed in accordance with the nozzle-forming method I described in Experiment B. Thus, there were obtained eighteen kinds of silane material-applied recording head samples A-1 to A-18. As for each of these silane material-applied recording head samples, eight samples were prepared.

Preparation of comparative recording head sample A applied with no silane material:

The procedures of preparing the silane material-applied recording head sample A-1 were repeated, except that no silane coupling agent was applied to each of the recessed portions formed at the second protective layer of the substrate sample No. 6, to thereby obtain a comparative recording head sample A applied with no silane material. As for this comparative recording head, there were prepared eight samples.

PREPARATION OF SILANE MATERIAL-APPLIED RECORDING HEAD SAMPLES A-1 TO A-18:

The procedures of preparing each of the silane material-applied recording head samples A-1 to A-18 were repeated, except that the nozzle-forming method I was replaced by the nozzle-forming method II described in Experiment B. Thus, there were obtained eighteen kinds of silane material-applied recording head samples a-1 to a-18. As for each of these silane material-applied recording head samples, eight samples were prepared.

Preparation of comparative recording head sample a applied with no silane material:

The procedures of preparing the silane material-applied recording head sample a-1 were repeated, except that no silane coupling agent was applied to each of the recessed portions formed at the second protective layer of the substrate sample, to thereby obtain a comparative recording head sample a applied with no silane material.

As for this comparative recording head sample, there were prepared eight samples.

In the above, the application of the silane coupling agent when the nozzle-forming method I was employed was conducted at the stage prior to the lamination of the negative dry film. And the application of the silane coupling agent when the nozzle-forming method II was employed was conducted at the stage prior to the application of the positive resist.

In any case, the application of the silane coupling agent was conducted in the following manner. That is, a given silane coupling agent was diluted with ethanol to 2%. The resultant solution was applied onto the substrate at the stage prior to the nozzle formation using a spinner under the conditions of 3000 rpm for revolution speed and 25 seconds for application period. The resultant applied with the silane coupling agent was subjected to heat treatment at 100° C. for 20 minutes.

The eighteen siliane coupling agents shown in Table 18 which were used in the above are products provided by Union Carbide Company.

EVALUATION (1) As for each of the silane material-applied recording head samples A-1 to A-18 and the comparative recording head sample A applied with no silane material, evaluation was conducted of the adhesion between the nozzle-forming walls and the substrate in the same manner as in Experiment B, wherein the ink A was used.

The evaluated results obtained are collectively shown in Table 19.

(2) As for each of the silane material-applied recording head samples a-1 to a-18 and the comparative recording head sample a applied with no silane material, evaluation was conducted of the adhesion between the nozzle-forming walls and the substrate in the same manner as in Experiment B, wherein the ink A was used.

The evaluated results obtained are collectively shown in Table 20.

(3) As for each of the silane material-applied recording head samples A-1 to A-18 and the comparative recording head sample A applied with no silane material, evaluation was conducted of the adhesion between the nozzle-forming walls and the substrate in the same manner as in Experiment B, wherein the ink B was used.

The evaluated results obtained are collectively shown in Table 21.

(4) As for each of the silane material-applied recording head samples a-1 to a-18 and the comparative recording head sample a applied with no silane material, evaluation was conducted of the adhesion between the nozzle-forming walls and the substrate in the same manner as in Experiment B, wherein the ink B was used.

The evaluated results obtained are collectively shown in Table 22.

Based on the results shown in Tables 19 to 22, the following findings have been obtained. That is, of the eighteen silane coupling agents used in the above, the silane coupling agents Nos. 5, 7, 8 and 9 are effective in providing a highly reliable adhesion for the junction of the substrate for ink jet recording head with the nozzle-forming walls which is not deteriorated and free of occurrence of fringe pattern even upon repeated use of the recording head over a long period of time; it is important to treat each of the recessed portions formed at the second protective layer with a specific silane coupling agent in order to attain an improved adhesion for the junction of the substrate for ink jet recording head with the nozzle-forming walls; and specific examples of such silane coupling agent are γ-methacryloxypropyltrimethoxysilane, β-(3,4-epoxycyclohexyl)-ethyltrimethoxysilane, γ-glycidoxypropyltrimethoxysilane, and γ-mercaptopropyltrimethoxysilane.

EXPERIMENT D

In this experiment, studies were made of the possibility of further improving the adhesion between the nozzle-forming walls and the substrate for ink jet recording head by using a mixture composed of a silane coupling agent and a silicon compound (this mixture will be hereinafter referred to as "mixed material").

PREPARATION OF MIXED MATERIAL-APPLIED RECORDING HEAD SAMPLES A-1 AND A-2

Preparation of mixed material-applied recording head sample A-1:

There was provided a single crystalline Si wafer of 100 mm×350 mm in size (produced by Wacker Company) having a 2.5 μm thick thermal oxide layer formed on the surface thereof as the base member.

Using this base member, the procedures of preparing the substrate sample A-1 in Experiment A were repeated to obtain a substrate for ink jet recording head having the same configuration as the substrate sample No. 6 shown in Table 4 except for changing the number of the heat generating resistors to 8576 and the length of the substrate to 300 mm.

To each of the recessed portions formed at the second protective layer, a mixed material obtained by dissolving, in ethanol, y-mercaptopropyltriethoxysilane (trademark name : A-189, produced by Union Carbide Company) in an amount to provide a 2 wt. % concentration to obtain a silane solution and resolving, in said silane solution, $Si(OH)_4$ (trademark name: OCD Type 2, produced by Tokyo Ohka Kabushiki Kaisha) in an amount to provide a 1 wt. % concentration was applied by the spin coating technique.

Then, using the substrate obtained in the above, the procedures of preparing the recording head sample A-1 in Experiment B were repeated, except that the heat treatment was conducted at 300° C. for 60 minutes in a $N_2$ gas atmosphere in an oven, to obtain a mixed material-applied recording head sample A-1. In this way, there were prepared eight mixed material-applied recording head samples A-1.

In the above, at the time of the nozzle formation, there were used the following apparatus:

an in-line developing apparatus (produced by Dainippon Screen Seizo Kabushiki kaisha) as the apparatus for the development of the negative dry film, and a roll coater (produced by Dainippon Screen Seizo Kabushiki kaisha) as the apparatus for the application of the positive resist.

Preparation of mixed material-applied recording head sample A-2:

The procedures of preparing the mixed material-applied recording head sample A-1 were repeated, except that the mixed material was replaced by a mixed material obtained by dissolving, in ethanol, γ-mercaptopropyltriethoxysilane (trademark name: A-189, produced by Union Carbide Company) in an amount to provide a 2 wt. % concentration to obtain a silane solution and resolving, in said silane solution, $CH_3Si$ (trademark name: OCD Type 7-85R, produced by Tokyo Ohka Kabushiki Kaisha) in an amount to provide a 1 wt. % concentration. Thus, there was obtained a mixed material-applied recording head sample A-1. In this way, there were prepared eight mixed material-applied recording head samples A-1.

PREPARATION OF COMPARATIVE RECORDING HEAD SAMPLE A APPLIED WITH NO INORGANIC COMPOUND

The procedures of preparing the mixed material-applied recording head sample A-1 were repeated, except that the silicon compound $Si(OH)_4$ was not used, to thereby obtain a comparative recording head sample A. In this way, there were prepared eight comparative recording head samples A applied with no inorganic compound.

PREPARATION OF MIXED MATERIAL-APPLIED RECORDING HEAD SAMPLES B-1 AND B-2

Preparation of mixed material-applied recording head sample B-1:

The procedures of preparing the mixed material-applied recording head sample A-1 were repeated, except that the first protective layer was composed of $Ta_2O_5$ and the second protective layer was composed of Cr, to thereby obtain a mixed material-applied recording head sample B-1. In this way, there were prepared eight mixed material-applied recording head samples B-1.

Preparation of mixed material-applied recording head sample B-2:

The procedures of preparing the mixed material-applied recording head sample A-2 were repeated, except that the first protective layer was composed of $Ta_2O_5$ and the second protective layer was composed of Cr, to thereby obtain a mixed material-applied recording head sample B-2. In this way, there were prepared eight mixed material-applied recording head samples B-2.

PREPARATION OF COMPARATIVE RECORDING HEAD SAMPLE B APPLIED WITH NO INORGANIC COMPOUND

The procedures of preparing the mixed material-applied recording head sample B-1 were repeated, except that the silicon compound $Si(OH)_4$ was not used, to thereby obtain a comparative recording head sample B. In this way, there were prepared eight comparative recording head samples B applied with no inorganic compound.

PREPARATION OF MIXED MATERIAL-APPLIED RECORDING HEAD SAMPLES C-1 AND C-2

Preparation of mixed material-applied recording head sample C-1:

The procedures of preparing the mixed material-applied recording head sample A-1 were repeated, except that the first protective layer was composed of $Si_3N_4$ and the second protective layer was composed of Pt, to thereby obtain a mixed material-applied recording head sample C-1. In this way, there were prepared eight mixed material-applied recording head samples C-1.

Preparation of mixed material-applied recording head sample C-2:

The procedures of preparing the mixed material-applied recording head sample A-2 were repeated, except that the first protective layer was composed of $Si_3N_4$ and the second protective layer was composed of Pt, to thereby obtain a mixed material-applied recording head sample C-2. In this way, there were prepared eight mixed material-applied recording head samples C-2.

PREPARATION OF COMPARATIVE RECORDING HEAD SAMPLE C APPLIED WITH NO INORGANIC COMPOUND

The procedures of preparing the mixed material-applied recording head sample C-1 were repeated, except that the silicon compound $Si(OH)_4$ was not used, to thereby obtain a comparative recording head sample C. In this way, there were prepared eight comparative recording head samples C applied with no inorganic compound.

EVALUATION

As for each recording head sample, evaluation was conducted with respect to withstand voltage property and adhesion reliability in the following manner.

Evaluation of withstand voltage property:

The evaluation of withstand voltage property was conducted in accordance with the same manner of the withstand voltage test described in Experiment A, except that the range for the voltage applied to be varied was changed to a range of from +30 V to −30 V, wherein the value of an electric current flown in ink was measured. And the evaluation based on the measured results was conducted on the basis of the same criteria as in Experiment A.

The evaluated results obtained are collectively shown in Table 23.

On the basis of the results shown in Table 23, it has been found that in the case of an ink jet recording head provided with the substrate for ink jet recording head in which each of the recessed portions formed at the second protective layer is treated with a silane coupling agent containing a silicon compound, an electric current is substantially not flown into ink even upon applying a high voltage, and the ink jet recording head excels in withstand voltage property, wherein the heat generating resistors or/and the electrodes are free of the problem of suffering from electric erosion.

Evaluation of adhesion reliability:

The evaluation of adhesion reliability was conducted in the same manner as in Experiment B using the ink B.

The evaluated results obtained are collectively shown in Table 24.

On the basis of the results shown in Table 24, it has been found that the adhesion between the nozzle-forming walls and the substrate for ink jet recording head treated with a mixed material composed of a silane coupling agent and a silicon compound is markedly excellent as well as that between the nozzle-forming walls and the substrate for ink jet recording head treated with a silane coupling agent only.

Separately, the above experiments were conducted using various mixed materials each comprising one of the silane coupling agents Nos. 5, 7 and 8 which provided satisfactory results in Experiment C and a given silane compound. As a result, a markedly improved adhesion was provided for the junction of the nozzle-forming walls with the substrate for ink jet recording head in any case.

DESCRIPTION OF THE PREFERRED EMBODIMENTS

As above described, the present invention provides an improved ink jet recording head which includes a substrate for ink jet recording head and a nozzle structural body provided with a plurality of nozzle-forming walls which is disposed over said substrate for ink jet recording head, said substrate for ink jet recording head comprising (a) a base member, (b) a heat generating resistor capable of generating, upon energization, thermal energy to be utilized for discharging ink, (c) a pair of electrodes electrically connected to said heat generating resistor, (d) a first protective layer, and (e) a second protective layer, wherein said heat generating resistor (b) and said pair of electrodes (c) are arranged on said base member (a), and said first protective layer (d) and said second protective layer (e) are disposed in this order over said heat generating resistor (b) and said pair of electrodes (c), characterized in that a plurality of given portions of said second protective layer (e) each situated at a position where said nozzle structural body is joined through one of said nozzle-forming walls to said substrate for ink jet recording head are recessed while leaving opposite stepped portions of said second protective layer (e) situated above said pair of electrodes (c).

The ink jet recording head according to the present invention includes an embodiment in which each of the recessed portions formed at the second protective layer (e) is applied with a specific silane coupling agent.

The ink jet recording head according to the present invention includes a further embodiment in which each of the recessed portions formed at the second protective layer (e) is applied with a mixture composed of a specific silane coupling agent and a specific inorganic compound.

The principal feature of the ink jet recording head according to the present invention lies in the configuration of the second protective layer of the substrate for ink jet recording head in that a plurality of given portions of the second protective layer each being situated at the position where a nozzle-forming wall is joined to the substrate for ink jet head are recessed so that the first protective layer situated under the second protective layer is exposed at each of the recessed portions of the second protective layer. In a preferred embodiment of this configuration of the second protective layer, each of the recessed portions is provided at the second protective layer such that opposite stepped portions of the first protective layer formed depending upon the opposite ends of the electrode are covered by the second protective layer. And each of the recessed portions of the second protective layer is coated by a specific silane coupling agent or a mixture composed of a specific silane coupling agent and a specific inorganic compound.

A typical embodiment of the substrate for ink jet recording head according to the present invention is configured as shown in FIGS. 1(*a*) and 1(*b*). FIG. 1(*a*) is a schematic plan view illustrating the constitution of a typical embodiment of the substrate for ink jet recording head according to the present invention. FIG. 1(*b*) is a schematic sectional view, taken along the line X—Y in FIG. 1(*a*).

In FIGS. 1(*a*) and 1(*b*), reference numeral 1 indicates a base member comprising, for example, a single crystal wafer. Each of reference numerals 2 and 2*a* indicates a heat generating resistor layer with a given pattern formed on the base member 1, wherein the heat generating resistor layer 2*a* serves as a heat generating resistor. Each of reference numerals 3*a* and 3*b* indicates an electrode layer, wherein the electrode layer 3*a* serves as a selective electrode and the electrode layer 3*b* serves as a common electrode. The electrode layer 3*b* is formed on the heat generating layer 2 along the pattern of the heat generating resistor layer 2. Reference numeral 4 indicates a first protective layer which is disposed on the base member 1 so as to cover the heat generating resistor layers 2, the heat generating resistors 2*a*, and the electrode layers 3*a* and 3*b*. Reference numeral 5 indicates a second protective layer which is disposed on the first protective layer 4. Numeral reference 11 indicates a recessed portion in the form of a rectangular shape which is provided at each given portion of the second protective layer 5 situated above the electrode layer 3*b* so as to expose the first protective layer 4 through the recessed portion. The recessed portion 11 serves for fixing a nozzle-forming wall of a top plate to the substrate for ink jet recording head to establish an ink pathway. In a preferred embodiment, each of the recessed portions 11 formed at the second protective layer 5 is applied with a specific silane coupling agent or a mixture composed of said silane coupling agent and a specific inorganic compound.

The ink jet recording head according to the present invention is provided with the substrate for ink jet recording head shown in FIGS. 1(*a*) and 1(*b*).

Figure 2A:
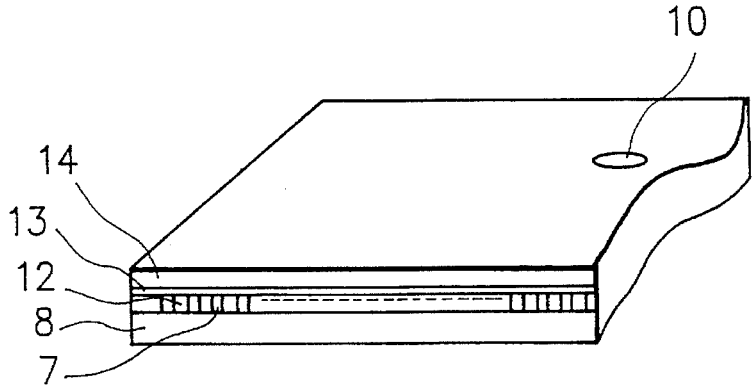
FIG. 2(*a*) is a schematic slant view illustrating the configuration of an example of an ink jet recording head according to the present invention.
Figure 2B:
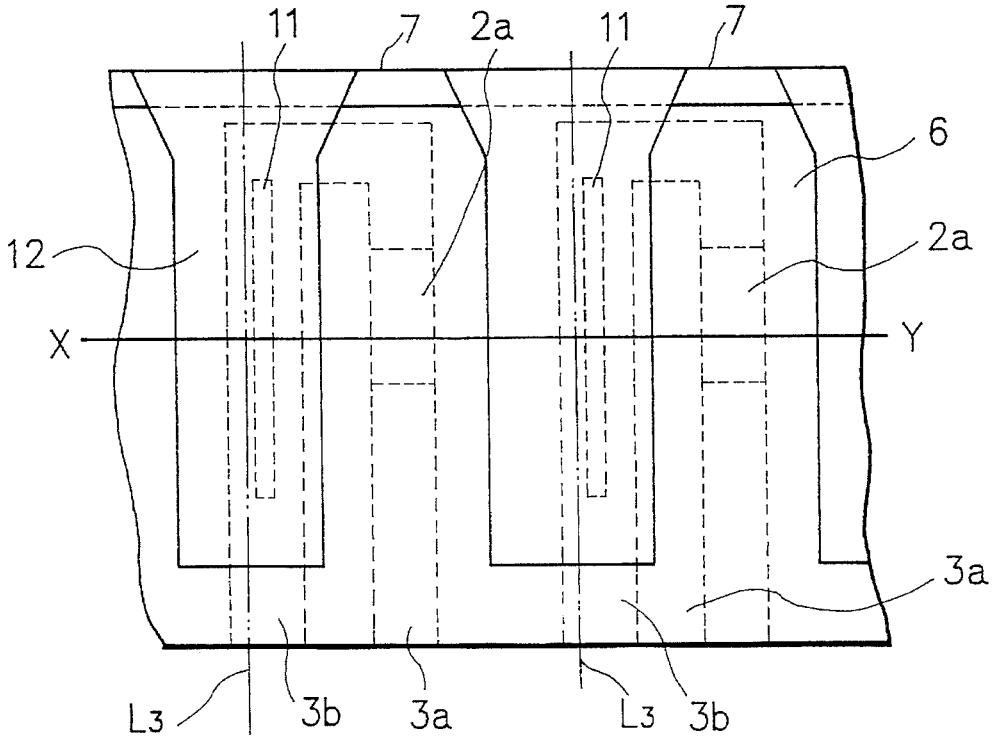
Figure 2C:
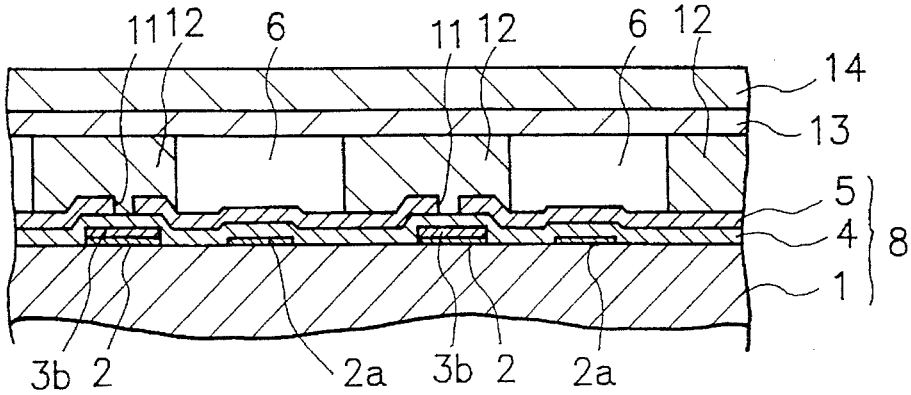

A typical embodiment of the ink jet recording head according to the present invention has such a configuration as shown in FIGS. 2(*a*) through 2(*c*).

In FIGS. 2(*a*) through 2(*c*), reference numeral 8 indicates the substrate for ink jet recording head shown in FIGS. 1(*a*) and 1(*b*).

FIG. 2(*a*) is a schematic view illustrating the entire of a complete ink jet recording head.

In FIGS. 2(*a*) through 2(*c*), reference numeral 14 indicates a top plate comprising a plate for the top plate which is provided with a plurality of nozzle-forming walls 12 through a dry film 13, reference numeral 6 indicates a ink pathway, and reference numeral 7 indicates a discharging outlet. The top plate 14 is provided with an ink supply port 10.

The ink jet recording head according to the present invention in this embodiment is one which is obtained by joining the top plate to the substrate 8 for ink jet recording head, in which each of the nozzle-forming walls 12 of the top plate is fixed to the substrate 8 through one of the recessed portions 11 formed at the second protective layer 5 of the substrate to establish the ink pathway 6 as shown in FIG. 2(*c*).

Another typical embodiment of the ink jet recording head according to the present invention has such a configuration as shown in FIGS. 3(*a*) through 3(*c*).

In FIGS. 3(*a*) through 3(*c*), reference numeral 8 indicates the substrate for ink jet recording head shown in FIGS. 1(*a*) and 1(*b*).

FIG. 3(*a*) is a schematic view illustrating the entire of a complete ink jet recording head.

In FIGS. 3(*a*) through 3(*c*), reference numeral 14 indicates a top plate comprising a plate for the top plate which is provided with a resin member having a plurality of nozzle-forming walls 15, reference numeral 6 indicates a ink pathway, and reference numeral 7 indicates a discharging outlet. The top plate 14 is provided with an ink supply port 10.

The ink jet recording head according to the present invention in this embodiment is one which is obtained by joining the top plate 14 to the substrate 8 for ink jet recording head, in which each of the nozzle-forming walls 15 of the top plate is fixed to the substrate 8 through one of the recessed portions 11 formed at the second protective layer 5 of the substrate to establish the ink pathway 6 as shown in FIG. 3(*c*).

In the following, description will be made of each of the constituents of the ink jet recording head according to the present invention.

The base member of the ink jet recording head may be a member made of single crystalline silicon, polycrystalline silicon, ceramics, glass or metals. Among these members, a member made of single crystalline silicon, a member made of polycrystalline silicon and a member made of glass are the most desirable in the viewpoints of easiness in handling and easiness in processing. The base member may of an appropriate form. However, it is desired to be in the form of a wafer shape or a rectangular shape.

The heat generating resistor of the ink jet recording head according to the present invention may be formed of any of the conventional materials which are known as a constituent material of the heat generating resistor of an ink jet recording head. Specific examples of such material are metal borides such as $HfB_2$, $ZrB_2$, $TiB_2$, and the like; metal oxides such as $TiO_2$, $SnO_2$, etc.; metal nitrides such as $Ta_2N$, and the like; metal silicates such as $Ta_2Si$, and the like; alloys such as Ni-Cr, Ta-A1, and the like; non-single crystalline silicon materials such as polycrystalline silicon, amorphous silicon, and the like. Among these materials, said metal borides, metal oxides, metal nitrides and alloys are the most desirable.

The heat generating resistor comprised of one of these materials may be properly formed by means of the conventional sputtering technique or evaporation technique.

Each of the electrode layers in the ink jet recording head according to the present invention may be formed of an appropriate metal such as A1, Cu, Au, etc. or an appropriate alloy such as alloys of said metals. The electrode comprised of one of these material may be properly formed by means of the conventional sputtering technique or evaporation technique.

The width of each of the electrode layers should be properly determined depending upon the related conditions including the density of nozzles (discharging outlets) to be arranged and the size of the heat generating resistor. However, in general, it is desired to be in the range of 8 μm to 30 μm.

The first protective layer of the ink jet recording head according to the present invention is formed on the base member such that it covers the heat generating resistor and the electrodes formed on the base member. The second protective layer is formed on the first protective layer. The first protective layer serves to prevent the heat generating resistor and the electrodes from suffering from electric erosion or dielectric breakdown. The second protective layer serves to prevent the heat generating resistor from being affected by cavitation (shock waves in other words) caused upon extinction of bubbles produced at the time of discharging recording liquid (ink).

The first protective layer is formed of a material which excels in insulating property and heat resisting property. Such material can include oxides of transition metals such as titanium oxide, vanadium oxide, niobium oxide, molybdenum oxide, tantalum oxide, tungsten oxide, chromium oxide, zirconium oxide, hafnium oxide, lanthanum oxide, yttrium oxide, manganese oxide, and the like; metal oxides such as aluminum oxide, calcium oxide, strontium oxide, barium oxide, silicon oxide, and the like; complexes of said metal oxides; nitrides such as silicon nitride, aluminum nitride, boron nitride, and the like; and oxides of said nitrides. Among these materials, said silicon dioxide ($SiO_2$), silicon nitride ($Si_3N_4$) and tantalum pentoxide ($Ta_2O_5$) are the most desirable in the viewpoints of easiness in handling, easiness in processing and material stability.

The second protective layer is formed of a material which excels in resistance to ink, chemical stability, resistance to cavitation and mechanical durability. Such material can include metals belonging to group IIIA of the periodic table such as Ta, and the like; metals belonging to group IVA of the periodic table such as Ti, and the like; metals belonging to group VA of the periodic table such as V, and the like; metals belonging to group VIA of the periodic table such as Cr, and the like; and metals belonging to group VIII of the periodic table such as Fe, Pt, Ir, and the like, and alloys of these metals such as Ti-Ni, Ta-W, Fe-Ni-Cr, and the like. Among these materials, Ta, Cr and Pt are the most desirable in the viewpoints of easiness in handling, easiness in processing and material stability.

Each of the first and second protective layers may be properly formed by means of any of the conventional film-forming techniques such as sputtering method, plasma CVD method, atmospheric pressure CVD method, low pressure CVD method, evaporation method, etc.

On the substrate for ink jet recording head comprising the heat generating resistor, the pair of electrode layers, the first protective layer and the second protective layer being disposed on the base member in the manner above described, the nozzle-forming wall is disposed between each pair of the adjacent heat generating resistors, whereby a plurality of nozzles each being capable of serving as an ink pathway are established.

As above described, in the ink jet recording head according to the present invention, a plurality of portions of the second protective layer each situated at the position where a nozzle-forming wall is joined to the substrate for ink jet recording head are recessed such that the first layer situated under the second protective layer is exposed at each of the recessed portions of the second protective layer while leaving a stepped portion of the second protective layer on either side of each of the recessed portions. The opposite stepped portions of the first protective layer formed depending upon the opposite ends of each of the electrode layers are covered by the second protective layer, and the nozzle-forming walls are contacted with the first protective layer through the exposed portions of the first protective layer. By this, the contact of the nozzle-forming walls with the substrate for ink jet recording head is maintained in a desirable state.

Each of the recessed portions formed at the second protective layer is formed by chipping a given portion of the second protective layer such that the opposite ends (that is, the opposite step portions) of the electrode situated under the first protective layer are covered by the second protective layer.

In a preferred embodiment, each of the recessed portions formed at the second protective layer is formed by chipping the second protective layer such that a layer portion with a given width of at least 1 μm or preferably 2 μm or more distance from the step end of the electrode situated under the second protective layer is remained on either side of the recessed portion.

The size of each of the recessed portions formed at the second protective layer may be properly designed as long as all the step portions of the electrodes are covered by not only the first protective layer but also the second protective layer as above described and the first protective layer is exposed at each of the recessed portions of the second protective layer as above described. However, in general, it is designed to be of a width in the range of 4 μm to 26 μm when the width of each of the electrodes is of 8 μm to 30 μm in width and the layer portion of the second protective layer remained on either side of each of the recessed portions is of 2 μm in width. Particularly, when the layer portion of the second protective layer remained on either side of each of the recessed portions while covering the step portion of the electrode is made to be of 1 μm in width, it is made to be of a width in the range of 6 μm to 28 μm.

In view of the resolution in the photolithography technique employed upon forming the recessed portions at the second protective layer, the size of each of the recessed portions is desired to be preferably at least about 2 μm, more preferably 4 μm or more.

In order to attain a secure adhesion between the substrate for ink jet recording head and the nozzle-forming walls joined to said substrate, a due care should be made not only about the width of each of the recessed portions provided at the second protective layer but also about its length and the position where each of the recessed portions is provided.

The length of each of the recessed portions provided at the second protective layer may be properly designed as long as the first protective layer is exposed at each of the recessed portions provided at the second protective layer. However, in general, it is desired to be preferably at least 5 μm, more preferably 10 μm or more.

As for the position for each of the recessed portions to be provided at the second protective, each of the recessed portions is designed to be situated at a position where the front end of the recessed portion is distant from the nozzle outlet end by preferably 150 μm or less or more preferably, 120 μm or less and the opposite end of the recessed portion is distant from the opposite end of the nozzle by preferably 100 μm or less or more preferably, 50 μm or less. By designing the position for each of the recessed portions like this, the nozzle-forming walls can be securely joined to the second protective layer with an improved adhesion.

As for each of the recessed portions provided at the second protective layer, as long as not only the above conditions relating to the width and length but also the above conditions relating to the location are satisfied, the center (expressed by a solid line $L_1$ in FIG. 1(A)) of the opening thereof is not always necessary to correspond to the center (expressed by a broken line $L_2$ in FIG. 1(A)) of the width of the electrode layer. Similarly, the opening center $L_1$ of the recessed portion is not always necessary to correspond to the center (expressed by a broken line $L_3$ in FIG. 2(B)) of the nozzle-forming wall. However, it is desired for the opening center of the recessed portion to be designed such that it corresponds not only to the center of the electrode layer but also to the center of the nozzle-forming wall in order to maintain a well-balanced junction between the nozzle structural body and the substrate for ink jet recording head.

Each of the recessed portions provided at the second protective layer may be properly formed by forming a layer for the second protective layer, patterning the layer by means of the photolithography technique, and subjecting the resultant to etching treatment by the dry-etching technique. The pattering treatment in this case may be conducted by means of the printing technique. The etching treatment in this case may be conducted by means of the wet-etching technique.

In the present invention, the respective portions of the first protective layer which are exposed through the recessed portions of the second protective layer are desired to be coated by a specific silane coupling agent. In this case, the junction between the nozzle structural body and the substrate for ink jet recording head is further secured.

Specific examples of the silane coupling agent are organofunctional silanes represented by the general formula $YRSiX_3$, with X being a hydrolyzable group bonded to silicon atom (Si) such as chloro group, alkoxy group or acetoxy group, Y being an organofunctional group such as vinyl group, methacryl group, acryl group, epoxy group, glycidoxy group, amino group, or mercapto group which is reactive with an organomatrix, and R being an alkyl group of 1 to 5 carbon atoms.

These organofunctional silanes used in the present invention are reactive silicone monomers having one or more functional groups in one molecule which can react with both an organic phase and an inorganic phase and chemically bond thereto.

Among the silane coupling agents comprising the organofunctional silanes represented by the foregoing general formula, those in which Y is acryl group, epoxy group or mercapto group are the most desirable since they provide a desirable adhesion.

Specific example of such organofunctional silane are -methacryloxypropyltrimethoxysilane, β-( 3,4-epoxycyclohexyly)-ethyltrimethoxysilane, -glycidoxypropyltrimethoxysilane, and -mercaptopropyltrimethoxysilane.

These silane coupling agents may be used either singly or in combination of two or more of them.

In the present invention, each of the portions of the first protective layer which are exposed through the recessed portions of the second protective layer is not always necessary to be entirely coated by the specific silane coupling agent as long as the region thereof served for the contact with the nozzle-forming wall of the nozzle structural body by the silane coupling agent. In a preferred embodiment, only the exposed region of the first protective layer served for is selectively coated by the silane coupling agent. In order for the silane coupling agent to exhibit a sufficient adhesion, the silane coupling agent applied to each of the recessed portions of the second protective layer through which the first protective layer is exposed is desired to be in an amount of providing a film with a thickness preferably in the range of 0.1 μm to 1 μm or more preferably in the range of 0.5 μm or less.

The application of the silane coupling agent to each of the recessed portions of the second protective layer may be conducted by preparing a coating composition by dissolving one or more of the foregoing organofunctional silanes in an appropriate organic solvent such as alcohol, ester, ketone, or the like, applying the coating composition in a prescribed amount to each of the recessed portions of the second protective layer by means of a coating technique, drying each of the resultants, followed by subjecting to heat treatment at a given temperature.

The coating technique in this case can include spin coating, roll coating, printing, spray coating, and dip coating techniques. Among these coating techniques, the spin coating and roll coating techniques are most desirable in the viewpoint that the thickness of the film formed can be easily controlled by these coating techniques.

The temperature upon the heat treatment is preferably 50° C. to 400° C., more preferably 100° C. to 200° C.

In the present invention, the silane coupling agent may be replaced by a mixture composed of the foregoing organofunctional silane as the silane coupling agent and one or more specific inorganic compounds (the mixture will be hereinafter referred to as mixed material).

The mixed material herein means a material obtained by resolving one or more of the foregoing organofunctional silanes and one or more given, specific inorganic compound in a organic solvent, drying the solution, and subjecting the resultant to heat treatment.

The use of the mixed material provides pronounced effects in that the adhesion between the nozzle-forming walls and the substrate for ink jet recording head is desirably enhanced, and the mixed material effects to supplement regions of the first protective layer which are insufficient in durability whereby the performance thereof of protecting the electrode layers and the heat generating resistors is improved and the first protective layer is provided with an improved pressure resistance. Particularly, the mixed material functions to prevent ions present, for example, in ink from permeating. Because of this, the electrode layers are desirably prevented from being corroded. In addition, defective portions of the first protective layer are filled with the mixed material upon the application of the mixed material.

Specific examples of the inorganic compound are silicon compounds such as $Si(OH)_4$, $CH_3Si(OH)_3$, alkylsilanols, and the like; compounds represented by the general formula $M(OR)_n$, with M being Al, Zr, Ti, Mg, or Fe, and R being an alkyl group of 1 to 5 carbon atoms; and compounds represented by the general formula $M(OH)_n$, with M being the same meaning as that of the former compounds. These inorganic compounds may be used either singly or in combination of two or more of them.

The amount of these inorganic compounds to be contained in the mixed material is desired to be preferably in the range of 0.5 to 10% by weight or more preferably in the range of 1 to 6% by weight versus the total amount of the mixed material on dry basis.

The application of a mixture composed of one or more of the foregoing organofunctional silanes as the silane coupling agent and one or more of the foregoing inorganic compounds to each of the recessed portions of the second protective layer may be conducted in the same manner as in the former case. Particularly, a coating composition is firstly prepared by dissolving one or more of the foregoing organofunctional silanes in a given amount and one or more of the foregoing inorganic compounds in a given amount in an appropriate organic solvent such as alcohol, ester, ketone, or the like, the coating composition thus obtained is applied to each of the recessed portions of the second protective layer in a prescribed amount capable of providing a film with such a thickness as described in the former case by means of a coating technique, each of the resultants in each of the recessed portions of the second protective layer is dried, followed by subjecting to heat treatment at a given temperature.

The coating technique in this case can include spin coating, roll coating, printing, spray coating, and dip coating techniques as well as in the former case. And among these coating techniques, the spin coating and roll coating techniques are most desirable in the viewpoint that the thickness of the film formed can be easily controlled by these coating techniques.

The temperature upon the heat treatment is preferably 200° C. to 500° C., more preferably 300° C. to 400° C.

The above described ink jet recording heat according to the present invention attains the previously described objects. Particularly, the ink jet recording head according to the present invention can be designed such that a number of ink discharging nozzles (or discharging outlets) can be arranged at a higher density than that in the prior art and which can be driven at a high frequency. In addition, the ink jet recording head according to the present invention can be properly designed to be an integrally elongated one. Further in addition, the ink jet recording head according to the present invention enables one to use any kind of ink as the recording liquid without any particular restriction therefor.

In fact, upon conducting recording using the ink jet recording head according to the present invention, there can be used various inks comprising water and organic solvent as the recording liquid. Such ink can include those inks of 1 to 20 cps in viscosity at 25° C. and 30 to 70 dyne/cm in surface tension. These inks may be of a pH value in the range of 3 to 12.

Thus, the ink jet recording head according to the present invention relaxes the restriction for the recording sheet used for recording.

Further, the ink jet recording head according to the present invention excels in pressure resistance, and because of this, it can be driven at a high voltage and at a relatively low electric current. This enables to reduce the number of costly ICs used, resulting in reducing the production cost of the ink jet recording head. This situation is markedly advantageous in the case of making the ink jet recording head to be an integrally prolonged one.

The present invention includes an ink jet recording apparatus provided with the above described ink jet recording head.

Particularly, the ink jet recording apparatus according to the present invention comprises an ink jet recording head and means for applying a driving signal to said ink jet recording head; said ink jet recording head comprising a substrate for ink jet recording head and a nozzle structural body provided with a plurality of nozzle-forming walls which is disposed on said substrate; said substrate comprising (a) a base member, (b) a heat generating resistor capable of generating, upon energization, thermal energy to be utilized for discharging ink, (c) a pair of electrode layers electrically connected to said heat generating resistor, (d) a first protective layer, and (e) a second protective layer, wherein said heat generating resistor (b) and said pair of electrode layers (c) are arranged on said base member (a), and said first protective layer (d) and said second protective layer (e) are disposed in this order over said heat generating resistor (b) and said pair of electrode layers (c), characterized in that a plurality of given portions of said second protective layer (e) each situated at a position where said nozzle structural body is joined through one of said nozzle-forming walls to said substrate for ink jet recording head are recessed while leaving opposite stepped portions of said second protective layer (e) situated above said pair of electrode layers (c).

The present invention includes the process for producing the above described ink jet recording head.

The process according to the present invention comprises the steps of (i) forming a heat generating resistor and a pair of electrode layers electrically connected to said heat generating resistor on a base member, (ii) forming a first protective layer and a second protective layer in this order over said heat generating resistor and said pair of electrode layers formed on said base member to thereby obtain a substrate, and (iii) arranging a nozzle structural body having a plurality of nozzle-forming walls on said substrate, characterized in that said process further comprises a step of (iv) spacedly removing said second protective layer situated at each position where said nozzle structural body is joined through one of said nozzle-forming walls to said substrate while leaving opposite stepped portions of said second protective layer situated above said pair of electrode layers to thereby spacedly establish a plurality of recessed portions at said second protective layer.

Figure 7:
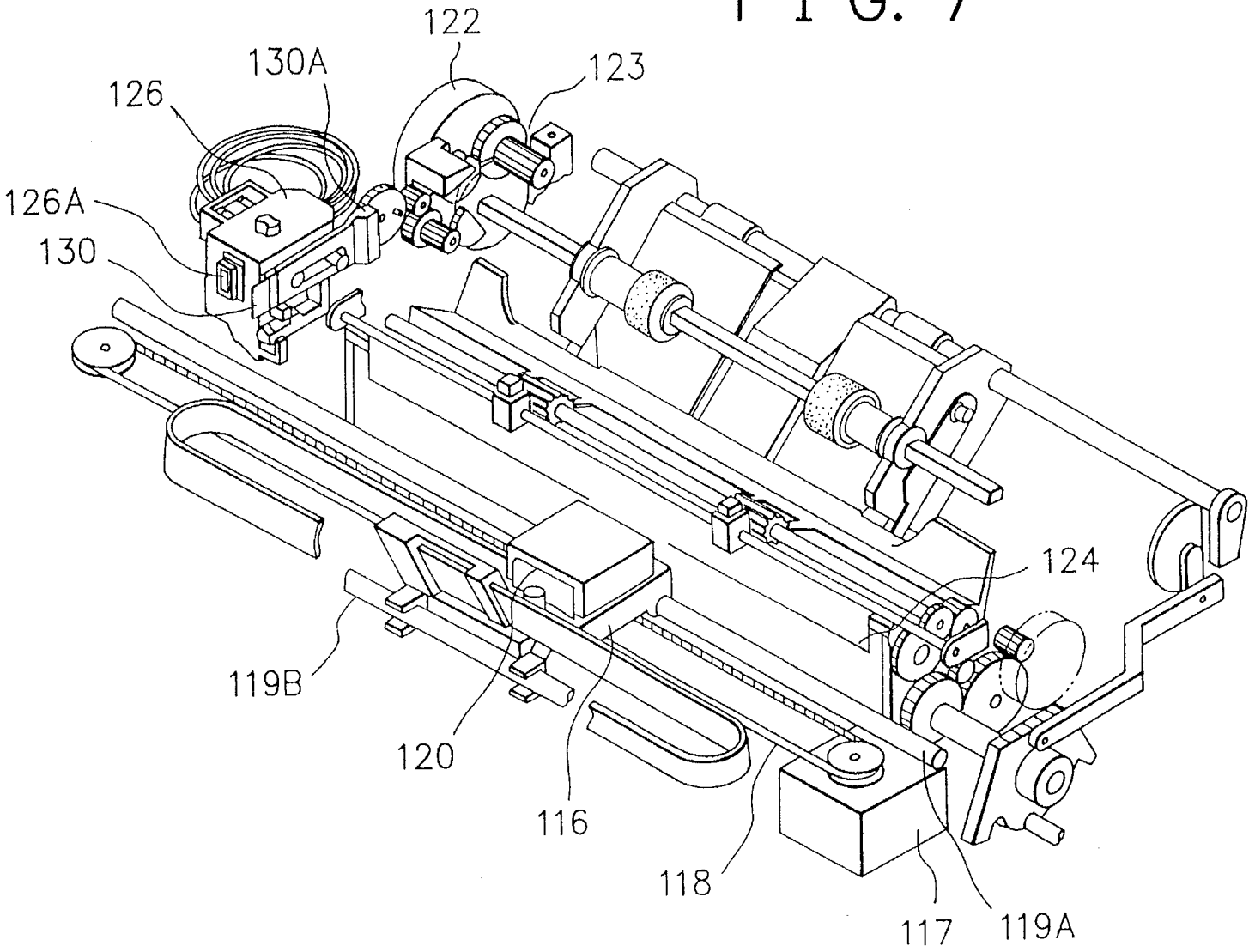
FIG. 7 is a schematic view illustrating the constitution of an example of an ink jet recording apparatus provided with an ink jet recording head according to the present invention.
Figure 8A:
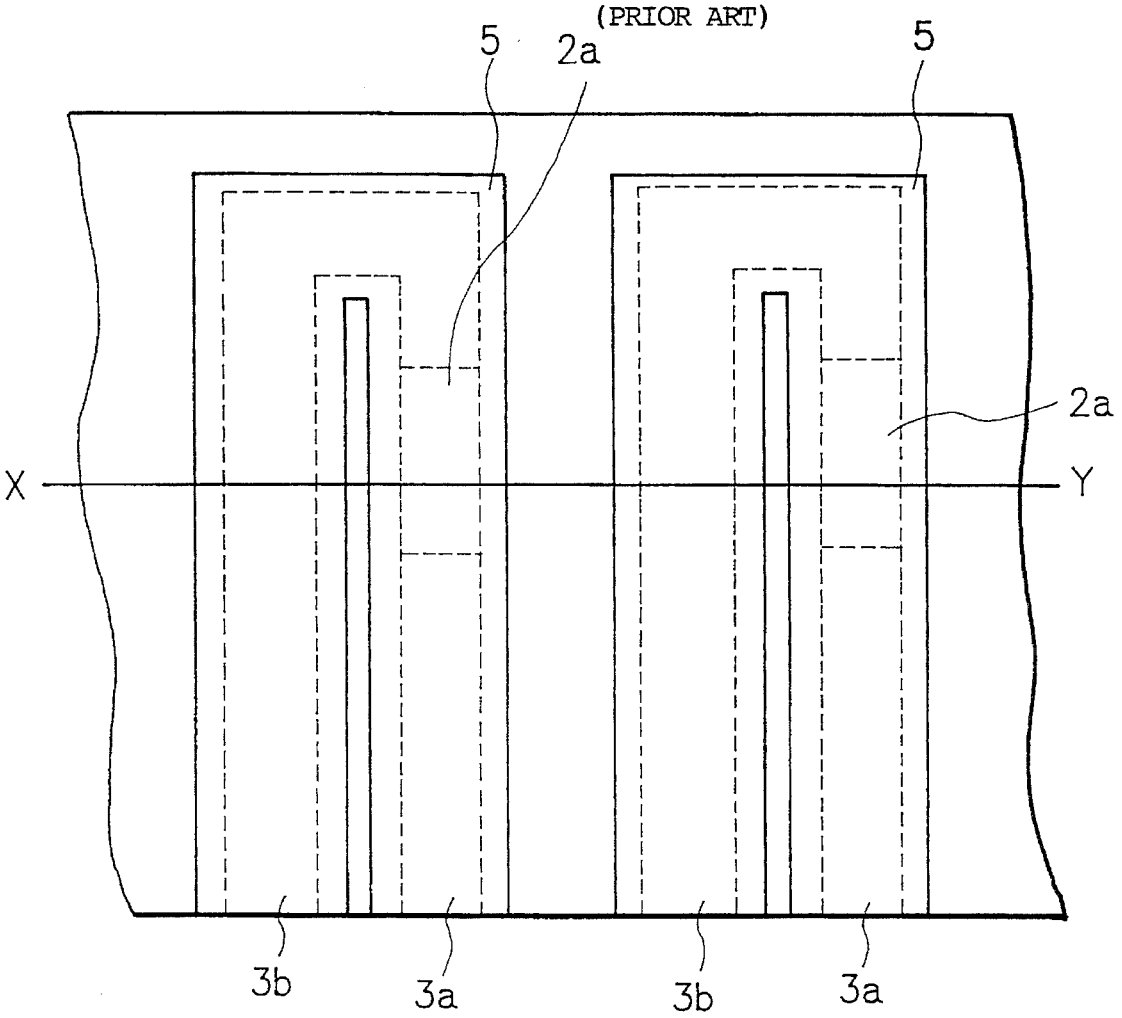
FIG. 8(a) (PRIOR ART)
FIG. 8(*a*) is a schematic plan view illustrating the configuration of a conventional substrate for ink jet recording head.
Figure 8B:
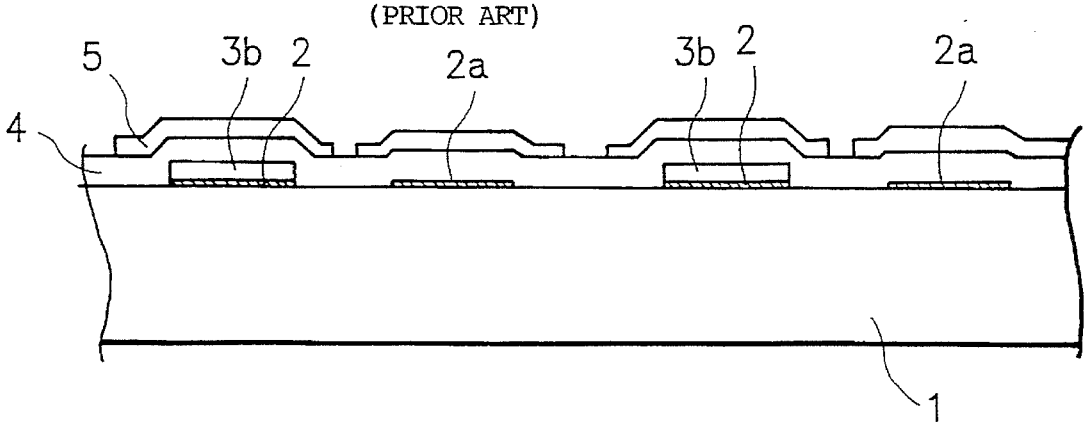
FIG. 8(b) (PRIOR ART)

Shown in FIG. 7 is an appearance perspective view illustrating an example of an ink jet recording apparatus IJRA in which the ink jet recording head according to the the present invention is used as an ink jet head cartridge IJC. In FIG. 7, reference numeral 120 indicates the ink jet head cartridge IJC provided with nozzle groups capable of discharging ink to the face of a recording member transported onto a platen 124. Reference numeral 116 indicates a carriage HC which serves to hold the IJC 120. The carriage HC is connected to a part of a driving belt 118 capable of transmitting a driving force such that it can be slidably moved together with two guide shafts 119A and 119B arranged in parallel with each other. By this, the IJC 120 is allowed to move back and forth along the entire of the recording member.

Herein, although the ink jet head cartridge as the recording head comprises a miniature recording head, it is a matter of course that the elongated ink jet recording head of the present invention, which is designed, for example, to be of a so-cally full line type capable of performing recording for a given recording width of a recording member used, can be used. In the case of using such elongated recording head, there can be attained a recording apparatus in which an advantage of being free of the problems of causing defects for an image recorded which are found in the case of using a relatively short recording head, and an advantage of making it possible to conduct high speed recording, are fully effectively used.

Reference numeral 126 indicates a head restoring device which is disposed at one end of the moving passage of the IJC 120, specifically at the position opposite the home position. The head restoring device 120 is operated by virtue of a driving force transmitted through a driving mechanism 123 from a motor 122, whereby capping the IJC 120. In relation to the capping for the IJC 120 by a cap member 126A of the head restoring device, the discharge restoration treatment of removing adhesive ink in the nozzles is conducted by way of ink sucking by means of an appropriate sucking means disposed in the head restoring device 126 or by way of ink pressure transportation by means of an appropriate pressurizing means whereby forcibly discharging the ink through the discharging outlets. When the recording is terminated, the IJC is protected by capping it.

Reference numeral 130 indicates a cleaning blade comprising a wiping member formed of a silicon rubber which is arranged at a side face of the head restoring device 126. The cleaning blade 130 is supported by a blade supporting member 130A in a cantilever-like state. As well as in the case of the head restoring device 126, the cleaning blade 130 is operated by virtue of a driving force transmitted through the driving mechanism 123 from the motor 122, wherein the cleaning blade is made capable of contacting with the discharging face of the IJC 120. By this, the cleaning blade 130 is projected into the moving passage of the IJC 120 timely with the recording performance of the IJC 120 or after the discharge restoration treatment using the head restoring device having been completed to thereby remove dew drops, wettings, dirts, and the like deposited on the discharging face of the IJC 120.

The recording apparatus is also provided with an electric signal applying means for applying an electric signal to the recording head. Further, the recording apparatus includes, other than the above embodiment of conducting recording to a recording member, an embodiment comprising a textile printing apparatus of recording patterns to a fabric or the like. In the case of the textile printing apparatus, it is necessary to conduct recording to a fabric with an extremely wide width, wherein the elongated recording head of the present invention is very effective.

The present invention provides prominent effects in an ink jet recording head and ink jet recording apparatus of the system in which ink is discharged utilizing thermal energy. As for the representative constitution and the principle, it is desired to adopt such fundamental principle as disclosed, for example, in U.S. Pat. No. 4,723,129 or U.S. Pat. No. 4,740,796. While this system is capable of applying either the so-called on-demand type or the continuous type, it is particularly effective in the case of the on-demand type because, by applying at least one driving signal for providing a rapid temperature rise exceeding nucleate boiling in response to recording information to an electrothermal converting body disposed for a sheet on which liquid (ink) is to be held or for a liquid pathway, the electrothermal converting body generates thermal energy to cause film boiling on a heat acting face of the recording head and as a result, a gas bubble can be formed in the liquid (ink) in a one-by-one corresponding relationship to such driving signal.

By way of growth and contraction of this gas bubble, the liquid (ink) is discharged through a discharging outlet to form at least one droplet. It is more desirable to make the driving signal to be of a pulse shape, since in this case, growth and contraction of a gas bubble take place instantly and because of this, there can be attained discharging of the liquid (ink) excelling particularly in responsibility.

As the driving signal of pulse shape, such driving signal as disclosed in U.S. Pat. No. 4,463,359 or U.S. Pat. No. 4,345,262 is suitable. Additionally, in the case where those conditions disclosed in U.S. Pat. No. 4,313,124, which relates to the invention concerning the rate of temperature rise at the heat acting face, are adopted, further improved recording can be performed.

As for the constitution of the recording head, the present invention includes, other than those constitutions of the discharging outlets, liquid pathways and electrothermal converting bodies in combination (linear liquid flow pathway or perpendicular liquid flow pathway) which are disclosed in the above-mentioned patent documents, the constitutions using such constitution in which a heat acting portion is disposed in a curved region as disclosed in U.S. Pat. No. 4,558,333 or U.S. Pat. No. 4,459,600 are also effective in the present invention.

In addition, the present invention may effectively take a constitution based on the constitution in which a slit common to a plurality of electrothermal converting bodies is used as a discharging portion of the electrothermal converting bodies which is disclosed in Japanese Unexamined Patent Publication No. 123670/1984 or another constitution based on the constitution in which an opening for absorbing a pressure wave of thermal energy is made to be corresponding to a discharging portion which is disclosed in Japanese Unexamined Patent Publication No. 138461/1984.

Further, in the case of an ink jet recording apparatus comprising a full-line type recording head having a length corresponding to the width of a maximum recording member onto which recording can be performed, the foregoing effects are more effectively provided. The present invention is effective also in the case where a recording head of the exchangeable chip type wherein electric connection to an apparatus body or supply of ink from the apparatus body is enabled when it is mounted on the apparatus body or other recording head of the cartridge type wherein an ink tank is integrally disposed on the recording head itself is employed.

Furthermore, the present invention is extremely effective not only in a recording apparatus which has, as the recording mode, a recording mode of a main color such as black but also in a recording apparatus which includes a plurality of different colors or at least one of full-colors by color mixture, in which a recording head is integrally constituted or a plurality of recording heads are combined.

In the above-described embodiments of the present invention, explanation has been made with the use of liquid ink, but it is possible to use such ink that is in a solid state at room temperature or other ink which becomes to be in a softened state at room temperature in the present invention. In the foregoing ink jet apparatus, it is usual to adjust the temperature of ink itself in the range of 30° C. to 70° C. such that the viscosity of ink lies in the range capable of being stably discharged. In view of this, any ink can be used as long as it is in a liquid state upon the application of a use record signal. It is also possible to those inks having a property of being liquefied, for the first time, with thermal energy, such as ink that can be liquefied and discharged in liquid state upon the application of thermal energy depending upon a record signal or other ink that can start its solidification beforehand at the time of its arrival at a recording member in order to prevent the temperature of the head from raising due to thermal energy purposely used as the energy for a state change of ink from solid state to liquid state or in order to prevent ink from being vaporized by solidifying the ink in a state of being allowed to stand.

In the following, the present invention will be described with reference to detailed examples which are only for illustrative purposes but are not intended to restrict the present invention.

EXAMPLE A AND COMPARATIVE EXAMPLE A

Example A

Preparation of a recording head unit sample A-1:

The recording head unit sample A-1 was prepared in the following manner.

Following the procedures described in the foregoing Experiment A, on a base member, there were spacedly formed 128 heat generating resistors having a width of 25 μm and a length of 100 μm at an equal interval of 70.5 μm, and a plurality of electrode layers having a width of 20 μm respectively at a position above which a nozzle-forming wall is to be positioned.

Then, a first protective layer composed of $SiO_2$ and a second protective layer composed of Ta were formed over the heat generating resistors and electrode layers formed in the above in the same manner as in the foregoing Experiment A. Successively, a recess with a width of 10 μm was formed at a plurality of given positions of the second protective layer each capable of being dedicated for the contact with a nozzle-forming wall.

Thus, there was obtained a substrate for ink jet recording head. Then, following the nozzle-forming procedures described in the foregoing Experiment B, there were formed a plurality of nozzles for the resultant substrate for ink jet recording head. Thus, there was obtained an ink jet recording head.

The resultant recording head was affixed to a base plate made of Al, to which a PBC was then affixed for attaining an electric connection. Thereafter, the electrode layers were electrically connected to the PBC by means of a wire bonding technique. Then, an ink supply tube was affixed to the ink supply port provided at the top plate. Thus, there was obtained a recording head unit sample A-1. In this way, there were prepared 100 recording head unit samples A-1 (hereinafter referred to as recording head unit sample group A-1).

Preparation of a recording head unit A-2:

The procedures of preparing the recording head unit sample A-1 were repeated, except that the number of the heat generating resistors formed was changed to 1024, to thereby obtain a recording head unit sample A-2. In this way, there were prepared 100 recording head unit samples A-2 (hereinafter referred to as recording head unit sample group A-2).

Preparation of a recording head unit A-3:

The procedures of preparing the recording head unit sample A-1 were repeated, except that the constituent of the first protective layer was changed to $Ta_2O_5$ and the constituent of the second protective layer was changed to Cr, to thereby obtain a recording head unit sample A-3. In this way, there were prepared 100 recording head unit samples A-3 (hereinafter referred to as recording head unit sample group A-3).

Preparation of a recording head unit A-4:

The procedures of preparing the recording head unit sample A-2 were repeated, except that the constituent of the first protective layer was changed to $Ta_2O_5$ and the constituent of the second protective layer was changed to Cr, to thereby obtain a recording head unit sample A-4. In this way, there were prepared 100 recording head unit samples A-4 (hereinafter referred to as recording head unit sample group A-4).

Preparation of a recording head unit A-5:

The procedures of preparing the recording head unit sample A-1 were repeated, except that the constituent of the first protective layer was changed to $Si_3N_4$ and the constituent of the second protective layer was changed to Pt, to thereby obtain a recording head unit sample A-5. In this way, there were prepared 100 recording head unit samples A-5 (hereinafter referred to as recording head unit sample group A-5).

Preparation of a recording head unit A-6:

The procedures of preparing the recording head unit sample A-2 were repeated, except that the constituent of the first protective layer was changed to $Si_3N_4$ and the constituent of the second protective layer was changed to Pt, to thereby obtain a recording head unit sample A-6. In this way, there were prepared 100 recording head unit samples A-6 (hereinafter referred to as recording head unit sample group A-6).

Comparative Example A

Preparation of a comparative recording head unit A-1:

The procedures of forming the recording head unit sample A-1 were repeated, except that no recess was formed at the second protective layer, to thereby obtain a comparative recording head unit sample A-1. In this way, there were prepared 100 comparative recording head unit samples A-1 (hereinafter referred to as comparative recording head unit sample group A-1).

Preparation of a comparative recording head unit A-2:

The procedures of forming the recording head unit sample A-3 were repeated, except that no recess was formed at the second protective layer, to thereby obtain a comparative recording head unit sample A-2. In this way, there were prepared 100 comparative recording head unit samples A-2 (hereinafter referred to as comparative recording head unit sample group A-2).

Preparation of a comparative recording head unit A-3:

The procedures of forming the recording head unit sample A-5 were repeated, except that no recess was formed at the second protective layer, to thereby obtain a comparative recording head unit sample A-3. In this way, there were prepared 100 comparative recording head unit samples A-3 (hereinafter referred to as comparative recording head unit sample group A-3).

Evaluation

As for each of the foregoing recording head unit sample groups A-1 to A-6 and each of the foregoing comparative recording head unit sample groups A-1 to A-3, one recording head unit sample was randomly chosen, and it was served for evaluation of printing performance, wherein printing precision and appearance of uneven density were evaluated using the ink A and the ink B described in the foregoing Experiment B.

In the evaluation, there was used a paper with a bleeding probability adjusted to be in a given range as the recording sheet. The recording head unit moving speed was made to be 70.5 μm/sec. And the driving conditions for the recording head unit were as follows:

voltage applied to the heat generating resistor:

1.15 Vth (Vth: discharging threshold voltage)(less than 20 V)

pulse width: 3 μm/sec. (the period of applying one pulse to the heat generating resistor), and driving frequency: 6 KHz (the voltage applying interval to the heat generating resistor).

There were obtained a number of printed samples. Of these printed samples, the printed sample obtained at the initial stage, the printed sample obtained after the integrated value of the driving pulse became $1\times10^8$, and the printed sample obtained after the integrated value of the driving pulse became $1\times10^9$ were evaluated with respect to printing precision and appearance of uneven density in the following manner.

Evaluation of printing precision:

As for each printed sample, the printed dot interval (the interval between the dot centers) was observed using a micrometer microscope, whereby a variation range was examined. In this case, the observation was conducted at 10 randomly selected positions each having an area 2 cm in square size on the printed sample, wherein the direction perpendicular to the paper moving direction was made to be X and the paper moving direction was made to be Y. The evaluation was conducted based on the following criteria. That is, the case where as for all the 10 positions each being of 2 cm in square size, the dot interval in the X direction and that in the Y direction were within a range of 50 μm to 90.5 μm, is made to be good "○", and the case other than this was evaluated as being not good "X".

The evaluated results when the ink A was used are collectively shown in Table 25. And the evaluated results when the ink B was used are collectively shown in Table 26.

Evaluation of appearance of uneven density:

Each printed sample was evaluated with respect to appearance of uneven density using a Macbeth densitometer. In this case, the entire area of the printed sample was read out by a CCD line sensor system, wherein the optical density was measured for every 1 cm width in the direction perpendicular to the paper moving direction. The evaluation was conducted based on the following criteria. That is, the case where the optical densities of the adjacent regions were within 0.2 is made to be good "○", and the case other than this was evaluated as being not good "X".

The evaluated results when the ink A was used are collectively shown in Table 25. And the evaluated results when the ink B was used are collectively shown in Table 26.

As apparent from the results shown in Tables 25 and 26, it is understood that any of the recording head unit samples according to the present invention is surpassing any of the comparative recording head unit samples. Particularly, any of the recording head unit samples according to the present invention in which the nozzle-forming walls are jointed to the substrate for ink jet recording head through the recessed portions of the second protective later through which the first protective layer is exposed stably exhibits its printing performance in a desirable state even after $1\times10^9$ times repetition of the driving pulse and thus, it excels in durability. In addition, as for any of the recording head unit samples according to the present invention, no breakage was observed as for the electrode layers and heat generating resistors even after $1\times10^9$ times repetition of the driving pulse.

EXAMPLE B AND COMPARATIVE EXAMPLE B

Example B

Preparation of a recording head unit sample B-1:

The recording head unit sample B-1 was prepared by repeating the procedures of preparing the recording head unit sample A-1, except that on a base member, there were spacedly formed 1024 heat generating resistors having a width of 20 μm and a length of 80 μm at an equal interval of 35 μm, and a plurality of electrode layers having a width of 10 μm respectively at a position above which a nozzle-forming wall is to be positioned, and that a recess with a width of 5 μm was formed at a plurality of given positions of the second protective layer each capable of being dedicated for the contact with the nozzle-forming wall, and the silane coupling agent No. 9 shown in Table 18 was applied to each of the recessed portions formed at the second protective layer in the same manner as in the foregoing Experiment C. In this way, there were prepared 100 recording head unit samples B-1 (hereinafter referred to as recording head unit sample group B-1).

Preparation of a recording head unit B-2:

The procedures of preparing the recording head unit sample B-1 were repeated, except that the constituent of the first protective layer was changed to $Ta_2O_5$ and the constituent of the second protective layer was changed to Cr, to thereby obtain a recording head unit sample B-2. In this way, there were prepared 100 recording head unit samples B-2 (hereinafter referred to as recording head unit sample group B-2).

Preparation of a recording head unit B-3:

The procedures of preparing the recording head unit sample B-1 were repeated, except that the constituent of the first protective layer was changed to $Si_3N_4$ and the constituent of the second protective layer was changed to Pt, to thereby obtain a recording head unit sample B-3. In this way, there were prepared 100 recording head unit samples B-3 (hereinafter referred to as recording head unit sample group B-3).

Comparative Example B

Preparation of a comparative recording head unit B-1:

The procedures of forming the recording head unit sample B-1 were repeated, except that no silane coupling agent was applied to the recessed portions formed at the second protective layer, to thereby obtain a comparative recording head unit sample B-1. In this way, there were prepared 100 comparative recording head unit samples B-1 (hereinafter referred to as comparative recording head unit sample group B-1).

Preparation of a comparative recording head unit B-2:

The procedures of forming the recording head unit sample B-2 were repeated, except that no silane coupling agent was applied to the recessed portions formed at the second protective layer, to thereby obtain a comparative recording head unit sample B-2. In this way, there were prepared 100 comparative recording head unit samples B-2 (hereinafter referred to as comparative recording head unit sample group B-2).

Preparation of a comparative recording head unit B-3:

The procedures of forming the recording head unit sample B-3 were repeated, except that no silane coupling agent was applied to the recessed portions formed at the second protective layer, to thereby obtain a comparative recording head unit sample B-3. In this way, there were prepared 100 comparative recording head unit samples B-3 (hereinafter referred to as comparative recording head unit sample group B-3).

Evaluation

As for each of the foregoing recording head unit sample groups B-1 to B-3 and each of the foregoing comparative recording head unit sample groups B-1 to B-3, one recording head unit sample was randomly chosen, and it was served for evaluation of printing performance, wherein printing precision and appearance of uneven density were evaluated in the same manner as in Example A and Comparative Example A using the ink A and the ink B described in the foregoing Experiment B.

The evaluated results when the ink A was used are collectively shown in Table 27. And the evaluated results when the ink B was used are collectively shown in Table 28.

As apparent from the results shown in Tables 27 and 28, it is understood that any of the recording head unit samples obtained in Example B is surpassing any of the comparative recording head unit samples obtained in Comparative Example B in terms of durability. Particularly, any of the recording head unit samples obtained in Example B in which the nozzle-forming walls are jointed to the substrate for ink jet recording head through the recessed portions applied with the silane coupling agent of the second protective later through which the first protective layer is exposed stably exhibits its printing performance in a desirable state even after $1\times10^9$ times repetition of the driving pulse. On the other hand, any of the comparative recording head unit samples obtained in Comparative Example B in which the recessed portions of the second protective layer are not applied with the silane coupling agent is inferior in terms of durability after $1\times10^9$ times repetition of the driving pulse. By the way, as for any of the recording head unit samples employed for the evaluation, no breakage was observed as for the electrode layers and heat generating resistors.

EXAMPLE C AND COMPARATIVE EXAMPLE C

Example C

Preparation of a recording head unit sample C-1:

The recording head unit sample C-1 was prepared by repeating the procedures of preparing the recording head unit sample B-1, except that the number of the heat generating resistors was changed from 1024 to 8576 and the silane coupling agent No. 9 shown in Table 18 applied to each of the recessed portions formed at the second protective layer was changed to a mixture composed of said silane coupling agent and a silicon compound $Si(OH)_4$. In this way, there were prepared 100 recording head unit samples C-1 (hereinafter referred to as recording head unit sample group C-1).

Preparation of a recording head unit C-2:

The procedures of preparing the recording head unit sample C-1 were repeated, except that the constituent of the first protective layer was changed to $Ta_2O_5$ and the constituent of the second protective layer was changed to Cr, to thereby obtain a recording head unit sample C-2. In this way, there were prepared 100 recording head unit samples C-2 (hereinafter referred to as recording head unit sample group C-2).

Preparation of a recording head unit C-3:

The procedures of preparing the recording head unit sample C-1 were repeated, except that the constituent of the first protective layer was changed to $Si_3N_4$ and the constituent of the second protective layer was changed to Pt, to thereby obtain a recording head unit sample C-3. In this way, there were prepared 100 recording head unit samples C-3 (hereinafter referred to as recording head unit sample group C-3).

Comparative Example C

Preparation of a comparative recording head unit C-1:

The procedures of forming the recording head unit sample C-1 were repeated, except that only the silane coupling agent was applied to the recessed portions formed at the second protective layer, to thereby obtain a comparative recording head unit sample C-1. In this way, there were prepared 100 comparative recording head unit samples C-1 (hereinafter referred to as comparative recording head unit sample group C-1).

Preparation of a comparative recording head unit C-2:

The procedures of forming the recording head unit sample C-2 were repeated, except that only the silane coupling agent was applied to the recessed portions formed at the second protective layer, to thereby obtain a comparative recording head unit sample C-2. In this way, there were prepared 100 comparative recording head unit samples C-2 (hereinafter referred to as comparative recording head unit sample group C-2).

Preparation of a comparative recording head unit C-3:

The procedures of forming the recording head unit sample C-3 were repeated, except that only the silane coupling agent was applied to the recessed portions formed at the second protective layer, to thereby obtain a comparative recording head unit sample C-3. In this way, there were prepared 100 comparative recording head unit samples C-3 (hereinafter referred to as comparative recording head unit sample group C-3).

Evaluation

As for each of the foregoing recording head unit sample groups C-1 to C-3 and each of the foregoing comparative recording head unit sample groups C-1 to C-3, one recording head unit sample was randomly chosen, and it was served for evaluation of printing performance, wherein printing precision and appearance of uneven density were evaluated in the same manner as in Example A and Comparative Example A using the ink A and the ink B described in the foregoing Experiment B, except that a driving voltage of 29.0 V and a driving current of 39.5 mA were employed for the recording head unit samples C-1 to C-3 and that a driving voltage of 19.5 V and a driving current of 60.5 mA were employed for the comparative recording head unit samples C-1 to C-3.

The evaluated results when the ink A was used are collectively shown in Table 29. And the evaluated results when the ink B was used are collectively shown in Table 30.

In each of Tables 29 and 30, the mark X indicates the case wherein a corrosion of more than 1 bit or/and a breakage were occurred at the electrode layers as for at least one of the 100 recording head unit samples.

As apparent from the results shown in Tables 29 and 30, it is understood that any of the recording head unit samples obtained in Example C is surpassing any of the comparative recording head unit samples obtained in Comparative Example C in terms of durability. Particularly, any of the recording head unit samples obtained in Example C in which the nozzle-forming walls are jointed to the substrate for ink jet recording head through the recessed portions applied with a mixture composed of the silane coupling agent and the silicon compound of the second protective later through which the first protective layer is exposed stably exhibits its printing performance in a desirable state even after $1\times10^9$ times repetition of the driving pulse without occurrence of corrosion or breakage at the electrode layers. On the other hand, any of the comparative recording head unit samples obtained in Comparative Example C in which the recessed portions of the second protective layer are applied with only the silane coupling agent is inferior in terms of durability particularly after $1\times10^9$ times repetition of the driving pulse wherein corrosion or breakage is liable to occur at the electrode layers.

As apparent from the above description, the present invention enables to insure a tight adhesion between the nozzle-forming walls and the substrate for ink jet recording head even in the case where the area of said substrate served for the contact with the nozzle-forming walls is small and enables to arrange a number of ink discharging nozzles (or discharging outlets) at a higher density than that in the prior art. The ink jet recording head provided according to the present invention is highly reliable and can be driven with a high driving frequency and at a high speed, wherein a high quality recorded image is stably and repeatedly provided. Further, the ink jet recording head according to the present invention enables to use any kind of ink as the recording liquid without any particular restriction therefor. Thus, the restriction for the recording sheet used for recording is relaxed.

Further in addition, the present invention enables to provide an elongated ink jet recording head with a high density in nozzle arrangement which is highly reliable especially in terms of durability and which attains high speed recording.

Furthermore, the present invention enables to reduce the number of costly ICs used, and because of this, a desirable ink jet recording head can be provided at a reduced production cost.

The present invention enables to provide a highly reliable ink jet recording apparatus by installing the improved ink jet recording head according to the present invention.

TABLE 1

| sub-strate sample No. | the width of the common electrode (μm) | the width of the reccessed portion at the second protective layer (μm) | the number of defective samples in terms of current value |
|---|---|---|---|
| A-1 | 20 | 5 | 0 |
| A-2 | 20 | 10 | 0 |
| A-3 | 20 | 30 | 40 |
| A-4 | 10 | 5 | 0 |
| A-5 | 10 | 10 | 10 |
| A-6 | 10 | 20 | 50 |

TABLE 2

| sub-strate sample No. | the width of the common electrode (μm) | the width of the reccessed portion at the second protective layer (μm) | the number of defective samples in terms of current value |
|---|---|---|---|
| A-7 | 20 | 5 | 0 |
| A-8 | 20 | 10 | 0 |
| A-9 | 20 | 30 | 60 |
| A-10 | 10 | 5 | 0 |
| A-11 | 10 | 10 | 25 |
| A-12 | 10 | 20 | 75 |

TABLE 3

| sub-strate sample No. | the width of the common electrode (μm) | the width of the reccessed portion at the second protective layer (μm) | the number of defective samples in terms of current value |
|---|---|---|---|
| A-13 | 20 | 5 | 0 |
| A-14 | 20 | 10 | 0 |
| A-15 | 20 | 30 | 25 |
| A-16 | 10 | 5 | 0 |
| A-17 | 10 | 10 | 10 |
| A-18 | 10 | 20 | 40 |

TABLE 4

| sub-strate sample | heat generating resistor | | | | the width of electrode at nozzle-forming wall | the width of the reccessed portion at the second protective layer |
|---|---|---|---|---|---|---|
| | size (μm) | | | number per | | |
| No. | width | length | interval | head | (μm) | (μm) |
| 1 | 25 | 100 | 70.5 | 128 | 20 | 10 |
| 2 | 25 | 100 | 70.5 | 1024 | 20 | 10 |
| 3 | 25 | 100 | 70.5 | 128 | 20 | 5 |
| 4 | 25 | 100 | 70.5 | 1024 | 20 | 5 |
| 5 | 20 | 80 | 35 | 128 | 10 | 5 |
| 6 | 20 | 80 | 35 | 1024 | 10 | 5 |

TABLE 5

| nozzle | nozzle | | | | | discharging outlet | |
|---|---|---|---|---|---|---|---|
| constitution | size (μm) | | | | number | size (μm) | |
| No. | width | length | height | interval | per head | width | height |
| 1 | 30 | 200 | 35 | 70.5 | 128 | 35 | 35 |

TABLE 5-continued

| nozzle constitution No. | nozzle size (μm) width | length | height | interval | number per head | discharging outlet size (μm) width | height |
|---|---|---|---|---|---|---|---|
| 2 | 30 | 200 | 35 | 70.5 | 1024 | 35 | 35 |
| 3 | 30 | 200 | 35 | 70.5 | 128 | 35 | 35 |
| 4 | 30 | 200 | 35 | 70.5 | 1024 | 35 | 35 |
| 5 | 15 | 200 | 25 | 35 | 128 | 12 | 25 |
| 6 | 15 | 200 | 25 | 35 | 1024 | 12 | 25 |

TABLE 6

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| A-1 | o | o | o | o | o | o | o | o |
| A-2 | o | o | o | o | o | o | o | o |
| A-3 | o | o | o | o | o | o | o | o |
| A-4 | o | o | o | o | o | o | o | o |
| A-5 | o | o | o | o | Δ | o | o | Δ |
| A-6 | o | o | o | Δ | Δ | o | Δ | Δ |
| Comp. A | o | Δ | Δ | x | x | Δ | x | x |

TABLE 7

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| B-1 | o | o | o | o | o | o | o | o |
| B-2 | o | o | o | o | Δ | o | o | Δ |
| B-3 | o | o | o | o | o | o | o | o |
| B-4 | o | o | o | o | Δ | o | o | Δ |
| B-5 | o | o | o | o | Δ | o | o | Δ |
| B-6 | o | o | o | Δ | x | o | Δ | x |
| Comp. B | o | Δ | x | x | x | x | x | x |

TABLE 8

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| C-1 | o | o | o | o | o | o | o | o |
| C-2 | o | o | o | o | o | o | o | o |
| C-3 | o | o | o | o | o | o | o | o |
| C-4 | o | o | o | o | o | o | o | o |
| C-5 | o | o | o | o | o | o | o | o |
| C-6 | o | o | o | o | Δ | o | o | Δ |
| Comp. C | o | Δ | Δ | x | x | Δ | x | x |

TABLE 9

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| a-1 | o | o | o | o | o | o | o | o |
| a-2 | o | o | o | o | o | o | o | o |
| a-3 | o | o | o | o | o | o | o | o |
| a-4 | o | o | o | o | o | o | o | o |
| a-5 | o | o | o | o | Δ | o | o | Δ |
| a-6 | o | o | o | o | Δ | o | o | Δ |
| Comp. a | o | o | Δ | Δ | x | Δ | Δ | x |

TABLE 10

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| b-1 | o | o | o | o | o | o | o | o |
| b-2 | o | o | o | o | o | o | o | o |
| b-3 | o | o | o | o | o | o | o | o |
| b-4 | o | o | o | o | o | o | o | o |
| b-5 | o | o | o | o | Δ | o | o | Δ |
| b-6 | o | o | o | Δ | x | o | Δ | x |
| Comp. b | o | Δ | Δ | x | x | Δ | x | x |

TABLE 11

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| c-1 | o | o | o | o | o | o | o | o |
| c-2 | o | o | o | o | o | o | o | o |
| c-3 | o | o | o | o | o | o | o | o |
| c-4 | o | o | o | o | o | o | o | o |
| c-5 | o | o | o | o | o | o | o | o |
| c-6 | o | o | o | o | Δ | o | o | Δ |
| Comp. c | o | Δ | Δ | x | x | Δ | x | x |

TABLE 12

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| A-1 | o | o | o | o | Δ | o | o | Δ |
| A-2 | o | o | o | o | o | o | | |
| A-3 | o | o | o | o | Δ | o | o | Δ |
| A-4 | o | o | o | o | x | o | o | x |
| A-5 | o | o | o | x | x | o | x | x |
| A-6 | o | o | Δ | x | x | o | x | x |
| Comp. A | x | x | x | x | x | x | x | x |

TABLE 13

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| B-1 | o | o | o | o | Δ | o | o | Δ |
| B-2 | o | o | o | o | Δ | o | o | Δ |
| B-3 | o | o | o | o | Δ | o | o | Δ |
| B-4 | o | o | o | o | Δ | o | o | Δ |
| B-5 | o | o | o | Δ | x | o | Δ | x |
| B-6 | o | o | Δ | Δ | x | o | Δ | x |
| Comp. B | x | x | x | x | x | x | x | x |

TABLE 14

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| C-1 | o | o | o | o | Δ | o | o | Δ |
| C-2 | o | o | o | o | Δ | o | o | Δ |
| C-3 | o | o | o | o | Δ | o | o | Δ |
| C-4 | o | o | o | o | Δ | o | o | Δ |
| C-5 | o | o | o | Δ | x | o | Δ | x |
| C-6 | o | o | o | Δ | x | o | Δ | x |
| Comp. C | Δ | x | x | x | x | Δ | x | x |

TABLE 15

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| a-1 | o | o | o | o | Δ | o | o | Δ |
| a-2 | o | o | o | o | Δ | o | o | Δ |
| a-3 | o | o | o | o | Δ | o | o | Δ |
| a-4 | o | o | o | o | Δ | o | o | Δ |
| a-5 | o | o | o | Δ | x | o | Δ | x |
| a-6 | o | o | Δ | x | x | o | x | x |
| Comp. a | Δ | x | x | x | x | Δ | x | x |

TABLE 16

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| b-1 | o | o | o | o | Δ | o | o | Δ |
| b-2 | o | o | o | o | Δ | o | o | Δ |
| b-3 | o | o | o | o | Δ | o | o | Δ |
| b-4 | o | o | o | o | Δ | o | o | Δ |
| b-5 | o | o | o | Δ | x | o | Δ | x |
| b-6 | o | o | Δ | Δ | x | o | Δ | x |
| Comp. b | Δ | x | x | x | x | Δ | x | x |

TABLE 17

| recording head sample | results of the PCT in ink (after hours) | | | | | results of the ink immersion endurance test (after months) | | |
|---|---|---|---|---|---|---|---|---|
| No. | 10 | 20 | 30 | 50 | 80 | 1 | 3 | 6 |
| c-1 | ○ | ○ | ○ | ○ | Δ | ○ | ○ | Δ |
| c-2 | ○ | ○ | ○ | ○ | Δ | ○ | ○ | Δ |
| c-3 | ○ | ○ | ○ | ○ | Δ | ○ | ○ | Δ |
| c-4 | ○ | ○ | ○ | ○ | Δ | ○ | ○ | Δ |
| c-5 | ○ | ○ | ○ | Δ | Δ | ○ | Δ | Δ |
| c-6 | ○ | ○ | ○ | Δ | X | ○ | Δ | X |
| Comp. c | Δ | Δ | X | X | X | Δ | X | X |

TABLE 18

| No. | compound name | structural formula | trademark name |
|---|---|---|---|
| 13 | γ-(bis(β-hydroxy-ethyl)) aminopropyl-triethoxysilane | $(HOCH_2CH_2)_2N(CH_2)_3Si(OC_2H_5)_2$ | A-1111 |
| 14 | γ-ureidopropyl-triethoxysilane | $NHCONH(CH_2)_3Si(OC_2H_5)_3$ | A-1160 |
| 15 | methyltrimethoxy-silane | $CH_3Si(OCH_3)_3$ | A-163 |
| 16 | methyltriethoxy-silane | $CH_3Si(OC_2H_5)_3$ | A-162 |
| 17 | γ-chloropropyl-trimethoxysilane | $ClCH_3CH_3CH_3Si(OCH_3)_3$ | A-143 |
| 18 | phenyltriethoxy-silane | 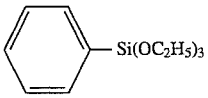 $Si(OC_2H_5)_3$ | A-153 |

TABLE 18-continued

| No. | compound name | structural formula | trademark name |
|---|---|---|---|
| 7 | β-(3,4-epoxycyclo-hexyl)-ethyltrimethoxysilane | 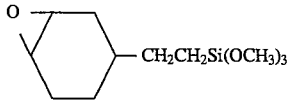 | A-186 |
| 8 | γ-glycidoxypropyl-trimethoxysilane | 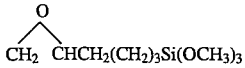 | A-187 |
| 9 | γ-mercaptopropyl-trimethoxysilane | $HSCH_2Ch_2CH_2Si(OCH_3)_3$ | A-189 |
| 10 | γ-aminopropyl-trimethoxysilane | $NH_2CH_2CH_2CH_2Si(OCH_3)_3$ | A-1110 |
| 11 | γ-aminopropyl-triethoysilane | $NH_2CH_2CH_2CH_2Si(OC_2H_5)_3$ | A-1100 |
| 12 | N-β(aminoethyl)γ-aminopropyl-trimethoxysilane | $NH_2(CH_2)_2NH(CH_2)_3Si(OCH_3)_3$ | A-1120 |
| 1 | vinyl trichloro-silane | $CH_2{=}2\ CHSiCl_3$ | A-150 |
| 2 | vinyl trimethoxy-silane | $CH_2{=}CHSi(OCH_3)_3$ | A-171 |
| 3 | vinyl triethoxy-silane | $CH_2{=}CHSi(OC_2H_5)_3$ | A-151 |
| 4 | vinyl triacetoxy-silane | $CH_2{=}CHSi(\overset{O}{\overset{\|\|}{O}}CCH_3)_3$ | A-188 |
| 5 | γ-methacryloxy-propyltrimethoxy-silane | $CH_2{=}\overset{CH_3}{\overset{\|}{C}}\ \overset{O}{\overset{\|\|}{C}}O(CH_2)_3Si(OCH_3)_3$ | A-174 |
| 6 | γ-methacryloxy-propyltris-(β-methoxyethoxy)-silane | $CH_2{=}\overset{CH_3}{\overset{\|}{C}}\ \overset{O}{\overset{\|\|}{C}}O(CH_2)_3Si(OCH_2CH_2OCH_3)_3$ | A-175 |

TABLE 19

| silane-material-applied recording head | results of the PCT in ink (after hours) | | | | | results of the ink immersion endurance test (after months) | | |
|---|---|---|---|---|---|---|---|---|
| sample No. | 10 | 20 | 30 | 50 | 80 | 1 | 3 | 6 |
| A-1 | ○ | ○ | ○ | Δ | Δ | ○ | Δ | Δ |
| A-2 | ○ | ○ | ○ | Δ | Δ | ○ | Δ | Δ |
| A-3 | ○ | ○ | ○ | Δ | Δ | ○ | Δ | Δ |
| A-4 | ○ | ○ | ○ | Δ | Δ | ○ | Δ | Δ |
| A-5 | ○ | ○ | ○ | ○ | ○ | ○ | ○ | ○ |
| A-6 | ○ | ○ | ○ | Δ | Δ | ○ | Δ | Δ |
| A-7 | ○ | ○ | ○ | ○ | ○ | ○ | ○ | ○ |
| A-8 | ○ | ○ | ○ | ○ | ○ | ○ | ○ | ○ |
| A-9 | ○ | ○ | ○ | ○ | ○ | ○ | ○ | ○ |
| A-10 | ○ | ○ | ○ | Δ | Δ | ○ | Δ | Δ |
| A-11 | ○ | ○ | ○ | Δ | Δ | ○ | Δ | Δ |
| A-12 | ○ | ○ | ○ | Δ | Δ | ○ | Δ | Δ |
| A-13 | ○ | ○ | ○ | Δ | Δ | ○ | Δ | Δ |
| A-14 | ○ | ○ | ○ | Δ | Δ | ○ | Δ | Δ |
| A-15 | ○ | ○ | ○ | Δ | Δ | ○ | Δ | Δ |
| A-16 | ○ | ○ | ○ | Δ | Δ | ○ | Δ | Δ |
| A-17 | ○ | ○ | ○ | Δ | Δ | ○ | Δ | Δ |
| A-18 | ○ | ○ | ○ | Δ | Δ | ○ | Δ | Δ |
| Comp. A | ○ | ○ | ○ | Δ | Δ | ○ | Δ | Δ |

TABLE 20

| silane-material-applied recording head | results of the PCT in ink (after hours) | | | | | results of the ink immersion endurance test (after months) | | |
|---|---|---|---|---|---|---|---|---|
| sample No. | 10 | 20 | 30 | 50 | 80 | 1 | 3 | 6 |
| a-1 | ○ | ○ | ○ | ○ | Δ | ○ | ○ | Δ |
| a-2 | ○ | ○ | ○ | ○ | Δ | ○ | ○ | Δ |
| a-3 | ○ | ○ | ○ | ○ | Δ | ○ | ○ | Δ |
| a-4 | ○ | ○ | ○ | ○ | Δ | ○ | ○ | Δ |
| a-5 | ○ | ○ | ○ | ○ | ○ | ○ | ○ | ○ |
| a-6 | ○ | ○ | ○ | ○ | Δ | ○ | ○ | Δ |
| a-7 | ○ | ○ | ○ | ○ | ○ | ○ | ○ | ○ |
| a-8 | ○ | ○ | ○ | ○ | ○ | ○ | ○ | ○ |
| a-9 | ○ | ○ | ○ | ○ | ○ | ○ | ○ | ○ |
| a-10 | ○ | ○ | ○ | ○ | Δ | ○ | ○ | Δ |
| a-11 | ○ | ○ | ○ | ○ | Δ | ○ | ○ | Δ |
| a-12 | ○ | ○ | ○ | ○ | Δ | ○ | ○ | Δ |
| a-13 | ○ | ○ | ○ | ○ | Δ | ○ | ○ | Δ |
| a-14 | ○ | ○ | ○ | ○ | Δ | ○ | ○ | Δ |
| a-15 | ○ | ○ | ○ | ○ | Δ | ○ | ○ | Δ |
| a-16 | ○ | ○ | ○ | ○ | Δ | ○ | ○ | Δ |
| a-17 | ○ | ○ | ○ | ○ | Δ | ○ | ○ | Δ |
| a-18 | ○ | ○ | ○ | ○ | Δ | ○ | ○ | Δ |
| Comp. a | ○ | ○ | ○ | ○ | Δ | ○ | ○ | Δ |

TABLE 21

| silane-material-applied recording head | results of the PCT in ink (after hours) | | | | | results of the ink immersion endurance test (after months) | | |
|---|---|---|---|---|---|---|---|---|
| sample No. | 10 | 20 | 30 | 50 | 80 | 1 | 3 | 6 |
| A-1 | ○ | ○ | Δ | X | X | ○ | X | X |
| A-2 | ○ | ○ | Δ | X | X | ○ | X | X |
| A-3 | ○ | ○ | Δ | X | X | ○ | X | X |
| A-4 | ○ | ○ | Δ | X | X | ○ | X | X |
| A-5 | ○ | ○ | ○ | ○ | ○ | ○ | ○ | ○ |
| A-6 | ○ | ○ | Δ | X | X | ○ | X | X |
| A-7 | ○ | ○ | ○ | ○ | ○ | ○ | ○ | ○ |
| A-8 | ○ | ○ | Δ | ○ | ○ | ○ | ○ | ○ |
| A-9 | ○ | ○ | ○ | ○ | ○ | ○ | ○ | ○ |
| A-10 | ○ | ○ | Δ | X | X | ○ | X | X |
| A-11 | ○ | ○ | Δ | X | X | ○ | X | X |
| A-12 | ○ | ○ | Δ | X | X | ○ | X | X |
| A-13 | ○ | ○ | Δ | X | X | ○ | X | X |
| A-14 | ○ | ○ | Δ | X | X | ○ | X | X |
| A-15 | ○ | ○ | Δ | X | X | ○ | X | X |
| A-16 | ○ | ○ | Δ | X | X | ○ | X | X |
| A-17 | ○ | ○ | Δ | X | X | ○ | X | X |
| A-18 | ○ | ○ | Δ | X | X | ○ | X | X |
| Comp. A | ○ | ○ | Δ | X | X | ○ | X | X |

TABLE 22

| silane-material-applied recording head | results of the PCT in ink (after hours) | | | | | results of the ink immersion endurance test (after months) | | |
|---|---|---|---|---|---|---|---|---|
| sample No. | 10 | 20 | 30 | 50 | 80 | 1 | 3 | 6 |
| a-1 | ○ | ○ | Δ | X | X | ○ | X | X |
| a-2 | ○ | ○ | Δ | X | X | ○ | X | X |
| a-3 | ○ | ○ | Δ | X | X | ○ | X | X |
| a-4 | ○ | ○ | Δ | X | X | ○ | X | X |
| a-5 | ○ | ○ | ○ | ○ | ○ | ○ | ○ | ○ |
| a-6 | ○ | ○ | Δ | X | X | ○ | X | X |
| a-7 | ○ | ○ | ○ | ○ | ○ | ○ | ○ | ○ |
| a-8 | ○ | ○ | ○ | ○ | ○ | ○ | ○ | ○ |
| a-9 | ○ | ○ | ○ | ○ | ○ | ○ | ○ | ○ |
| a-10 | ○ | ○ | Δ | X | X | ○ | X | X |
| a-11 | ○ | ○ | Δ | X | X | ○ | X | X |
| a-12 | ○ | ○ | Δ | X | X | ○ | X | X |
| a-13 | ○ | ○ | Δ | X | X | ○ | X | X |
| a-14 | ○ | ○ | Δ | X | X | ○ | X | X |
| a-15 | ○ | ○ | Δ | X | X | ○ | X | X |
| a-16 | ○ | ○ | Δ | X | X | ○ | X | X |
| a-17 | ○ | ○ | Δ | X | X | ○ | X | X |
| a-18 | ○ | ○ | Δ | X | X | ○ | X | X |
| Comp. a | ○ | ○ | Δ | X | X | ○ | X | X |

TABLE 23

| mixed material-applied recording head sample No. | the number of current-value defective samples |
|---|---|
| A-1 | 0 |
| A-2 | 0 |
| Comp. A | 70 |
| B-1 | 0 |
| B-2 | 0 |
| Comp. B | 40 |
| C-1 | 0 |
| C-2 | 0 |
| Comp. C | 50 |

TABLE 24

| mixed material-applied recording | results of the PCT in ink (after hours) | | | | | results of the ink immersion endurance test (after months) | | |
|---|---|---|---|---|---|---|---|---|
| head sample No. | 10 | 20 | 30 | 50 | 80 | 1 | 3 | 6 |
| A-1 | ○ | ○ | ○ | ○ | ○ | ○ | ○ | ○ |
| B-1 | ○ | ○ | ○ | ○ | ○ | ○ | ○ | ○ |
| C-1 | ○ | ○ | ○ | ○ | ○ | ○ | ○ | ○ |

TABLE 25

| recording | printing precision | | | appearance of uneven print density | | |
|---|---|---|---|---|---|---|
| head unit sample No. | initial stage | $1 \times 10^8$ | $1 \times 10^9$ | initial stage | $1 \times 10^8$ | $1 \times 10^9$ |
| A-1 | ○ | ○ | ○ | ○ | ○ | ○ |
| A-2 | ○ | ○ | ○ | ○ | ○ | ○ |
| A-3 | ○ | ○ | ○ | ○ | ○ | ○ |
| A-4 | ○ | ○ | ○ | ○ | ○ | ○ |
| A-5 | ○ | ○ | ○ | ○ | ○ | ○ |
| A-6 | ○ | ○ | ○ | ○ | ○ | ○ |
| Comp. A-1 | ○ | ○ | X | ○ | ○ | X |
| Comp. A-2 | ○ | ○ | X | ○ | ○ | X |
| Comp. A-3 | ○ | ○ | X | ○ | ○ | X |

TABLE 26

| recording | printing precision | | | appearance of uneven print density | | |
|---|---|---|---|---|---|---|
| head unit sample No. | initial stage | $1 \times 10^8$ | $1 \times 10^9$ | initial stage | $1 \times 10^8$ | $1 \times 10^9$ |
| A-1 | ○ | ○ | ○ | ○ | ○ | ○ |
| A-2 | ○ | ○ | ○ | ○ | ○ | ○ |
| A-3 | ○ | ○ | ○ | ○ | ○ | ○ |
| A-4 | ○ | ○ | ○ | ○ | ○ | ○ |
| A-5 | ○ | ○ | ○ | ○ | ○ | ○ |
| A-6 | ○ | ○ | ○ | ○ | ○ | ○ |
| Comp. A-1 | ○ | ○ | X | ○ | ○ | X |
| Comp. A-2 | ○ | X | X | ○ | X | X |
| Comp. A-3 | ○ | ○ | X | ○ | ○ | X |

TABLE 27

| recording | printing precision | | | appearance of uneven print density | | |
|---|---|---|---|---|---|---|
| head unit sample No. | initial stage | $1 \times 10^8$ | $1 \times 10^9$ | initial stage | $1 \times 10^8$ | $1 \times 10^9$ |
| B-1 | ○ | ○ | ○ | ○ | ○ | ○ |
| B-2 | ○ | ○ | ○ | ○ | ○ | ○ |
| B-3 | ○ | ○ | ○ | ○ | ○ | ○ |
| Comp. B-1 | ○ | ○ | X | ○ | ○ | X |
| Comp. B-2 | ○ | ○ | X | ○ | ○ | X |
| Comp. B-3 | ○ | ○ | X | ○ | ○ | X |

TABLE 28

| recording head unit sample No. | printing precision initial stage | $1 \times 10^8$ | $1 \times 10^9$ | appearance of uneven print density initial stage | $1 \times 10^8$ | $1 \times 10^9$ |
|---|---|---|---|---|---|---|
| B-1 | ○ | ○ | ○ | ○ | ○ | ○ |
| B-2 | ○ | ○ | ○ | ○ | ○ | ○ |
| B-3 | ○ | ○ | ○ | ○ | ○ | ○ |
| Comp. B-1 | ○ | X | X | ○ | X | X |
| Comp. B-2 | ○ | X | X | ○ | X | X |
| Comp. B-3 | ○ | X | X | ○ | X | X |

TABLE 29

| recording head unit sample No. | printing precision initial stage | $1 \times 10^8$ | $1 \times 10^9$ | appearance of uneven print density initial stage | $1 \times 10^8$ | $1 \times 10^9$ |
|---|---|---|---|---|---|---|
| C-1 | ○ | ○ | ○ | ○ | ○ | ○ |
| C-2 | ○ | ○ | ○ | ○ | ○ | ○ |
| C-3 | ○ | ○ | ○ | ○ | ○ | ○ |
| Comp. C-1 | ○ | ○ | X | ○ | ○ | X |
| Comp. C-2 | ○ | X | X | ○ | X | X |
| Comp. C-3 | ○ | ○ | X | ○ | ○ | X |

TABLE 30

| recording head unit sample No. | printing precision initial stage | $1 \times 10^8$ | $1 \times 10^9$ | appearance of uneven print density initial stage | $1 \times 10^8$ | $1 \times 10^9$ |
|---|---|---|---|---|---|---|
| C-1 | ○ | ○ | ○ | ○ | ○ | ○ |
| C-2 | ○ | ○ | ○ | ○ | ○ | ○ |
| C-3 | ○ | ○ | ○ | ○ | ○ | ○ |
| Comp. C-1 | ○ | X | X | ○ | X | X |
| Comp. C-2 | ○ | X | X | ○ | X | X |
| Comp. C-3 | ○ | ○ | X | ○ | ○ | X |

What is claimed is:

1. An ink jet recording head which includes a substrate for ink jet recording head and a nozzle structural body provided with a plurality of nozzle-forming walls which is disposed over said substrate for ink jet recording head, said substrate for ink jet recording head comprising (a) a base member, (b) a heat generating resistor for generating, thermal energy to be utilized for discharging an ink, (c) a pair of electrodes electrically connected to said heat generating resistor, (d) a first protective layer serving as an insulating layer, and (e) a second protective layer serving as a cavitation resistant layer and having a plurality of stepped portions, wherein said heat generating resistor (b) and said pair of electrodes (c) are arranged on said base member (a), and said first protective layer (d) and said second protective layer (e) are disposed in this order over said heat generating resistor (b) and said pair of electrodes (c), characterized in that said second protective layer is constructed such that a plurality of particular portions of said second protective layer (e) each have a recess defining a gap therethrough are each situated at a position where said nozzle structural body is joined by one of said nozzle-forming walls through an associated said recess to said substrate for ink jet recording head while said stepped portions of said second protective layer (e) having said recesses are situated above said pair of electrodes (c).

2. The ink jet recording head according to claim 1, wherein the nozzle-forming walls of the nozzle structural body are contacted with the first protective layer.

3. The ink jet recording head according to claim 1, wherein each of the recessed portions of the second protective layer is applied with a silane coupling agent.

4. The ink jet recording head according to claim 1, wherein each of the recessed portions of the second protective layer is applied with a mixture comprising a silane coupling agent and an inorganic compound.

5. The ink jet recording head according to claim 1, wherein said ink jet recording bead contains the ink.

6. An ink jet recording head as in claim 1, wherein the first protective layer is composed of a member selected from the group consisting of inorganic oxides, metal oxides, and metal nitrides.

7. An ink jet recording head as in claim 1, wherein the second layer is composed of a member selected from the group consisting of metals of periodic table groups IIIa, IVa, Va, VIa and VII and alloys of these said metals.

8. An ink jet recording apparatus which comprises an ink jet recording head and means for applying a driving signal to said ink jet recording head; said ink jet recording head comprising a substrate for ink jet recording head and a nozzle structural body provided with a plurality of nozzle-forming walls which are disposed on said substrate; said substrate comprising (a) a base member, (b) a heat generating resistor for generating thermal energy to be utilized for discharging an ink, (c) a pair of electrode layers electrically connected to said heat generating resistor, (d) a first protective layer serving as an insulating layer, and (e) a second protective layer serving as a cavitation resistant layer and having a plurality of stepped portions, wherein said heat generating resistor (b) and said pair of electrode layers (c) are arranged on said base member (a), and said first protective layer (d) and said second protective layer (e) are disposed in this order over said heat generating resistor (b) and said pair of electrode layers (c), characterized in that said second protective layer is constructed such that a plurality of particular portions of said second protective layer (e) each have a recess defining a gap therethrough and are each situated at a position where said nozzle structural body is joined by one of said nozzle-forming walls through an associated said recess to said substrate for ink jet recording head while said stepped portions of said second protective layer (e) having said recesses are situated above said pair of electrode layers (c).

9. The ink jet recording apparatus according to claim 8, wherein the nozzle-forming walls of the nozzle structural body are contacted with the first protective layer.

10. The ink jet recording apparatus according to claim 8, wherein each of the recessed portions of the second protective layer is applied with a silane coupling agent.

11. The ink jet recording apparatus according to claim 8, wherein each of the recessed portions of the second protective layer is applied with a mixture comprising a silane coupling agent and an inorganic compound.

12. An ink jet recording apparatus as in claim 8, wherein the first protective layer is composed of a member selected from the group consisting of inorganic oxides, metal oxides, and metal nitrides.

13. An ink jet recording apparatus as in claim 8, wherein the second layer is composed of a member selected from the group consisting of metals of periodic table groups IIIa, IVa, Va, VIa and VII and alloys of these said metals.

14. A process for producing an ink jet recording head which comprises the steps of (i) forming a heat generating resistor and a pair of electrode layers electrically connected to said heat generating resistor on a base member, (ii) forming a first protective layer serving as an insulating layer and a second protective layer serving as a cavitation resistant layer and having a plurality of stepped portions in this order over said heat generating resistor and said pair of electrode layers formed on said base member to thereby obtain a substrate, and (iii) arranging a nozzle structural body having a plurality of nozzle-forming walls on said substrate, characterized in that said process further comprises a step of (iv) spacedly removing a portion of said second protective layer so as to form a plurality of recesses each defining a gap therethrough situated at each position where said nozzle structural body is joined by one of said nozzle-forming walls through an associated said recess to said substrate while said stepped portions of said second protective layer having said recesses are situated above said pair of electrode layers to thereby spacedly establish a plurality of recessed portions at said second protective layer.

15. The process according to claim 14 which further comprises a step of applying a silane coupling agent to each of the recessed portions of the second protective layer.

16. The process according to claim 14 which further comprises a step of applying a mixture comprising a silane coupling agent and an inorganic compound to each of the recessed portions of the second protective layer.

17. A process as in claim 14, wherein the first protective layer is composed of a member selected from the group consisting of inorganic oxides, metal oxides, and metal nitrides.

18. A process as in claim 14, wherein the second layer is composed of a member selected from the group consisting of metals of periodic table groups IIIa, IVa, Va, VIa and VII and alloys of these said metals.

* * * * *

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

AT [57] ABSTRACT

Line 20, "A" should read --An--.

COLUMN 1

Line 32, "used" should read --be used--.
Line 49, "cross" should read --cross- --.

COLUMN 2

Line 17, "as," should read --as--.
Line 30, "wards)" should read --words)--.

COLUMN 5

Line 24, "under described." should read --described below.--.
Line 39, "a ink" should read --an ink--.

COLUMN 6

Line 21, "(b)." should read --8(b).--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 7

Line 1, "Other" should read --Another--.
Line 58, "other" should read --another--.
Line 65, "stepwisely" should read --stepwise--.

COLUMN 8

Line 1, "stepwisely" should read --stepwise--.
Line 2, "other" should read --another--.

COLUMN 9

Line 27, "Generating" should read --generating--.

COLUMN 11

Line 27, "an" should read --a--.
Line 66, "Preparation" should read --¶ Preparation--.

COLUMN 13

Line 20, "chemicall" should read --chemically--.
Line 64, "thereby" should read --thereby obtain--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 14

Line 30, "thereby" should read --thereby obtain--.
Line 55, "thereby" should read --thereby obtain--.

COLUMN 15

Line 15, "sample B-1" should read --samples B-1--.
Line 22, "sample C-1" should read --samples C-1--.

COLUMN 16

Line 56, "a" should read --an--.

COLUMN 17

Line 59, "patways," should read --pathways,--.
Line 66, "a" should read --an--.

COLUMN 18

Line 32, "USED:" should read --USED--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 19

Line 10, "portion" should read --portions--.

COLUMN 21

Line 54, "y-" should read --γ- --

COLUMN 25

Line 34, "entire" should read --entirety-.
Line 40, "a ink" should read --an ink--.
Line 58, "entire" should read --entirety--.
Line 64, "a" should read --an--.

COLUMN 26

Line 17, "may" should read --may be--.
Line 41, "material" should read --materials--.

COLUMN 27

Line 65, "distance" should read --distant--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 28

Line 35, "protective," should read --protective layer,--.
Line 67, "pattering" should read --patterning--.

COLUMN 29

Line 27, "example" should read --examples -- and "silane" should read ----silanes--
Line 28, "-methacryloxypropyltrimethoxysilane," should read --γ-methacryloxypropyltrimethoxysilane,--.
Line 29, "hexyly)" should read --hexyl)-- and "glycidoxypropyltrimethox-" should read --γ-glycidoxypropyltrimethox- --.
Line 30, "-mercaptopropyltrimethoxysilane." should read --γ-mercaptopropyltrimethoxysilane.--.

COLUMN 30

Line 8, "a" should read --an--.
Line 66, "above described" should read --above-described-- and "heat" should read --head--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 31

Line 30, "above described" should read --above-described--.
Line 57, "above described" should read --above-described--.

COLUMN 32

Line 21, "entire" should read --entirety--.
Line 27, "so-cally" should read --so-called--.

COLUMN 38

Line 46, "jointed" should read --joined--.

COLUMN 40

Line 20, "jointed" should read --joined--.

COLUMN 45

Line 9, "A-2 O O O O O O" should read --A-2 O O O O O O O O O--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 47

Table 18 Cont'd., No. 9, "$Ch_2$" should read --$CH_2$-- and
No. 11, "triethoysilane" should read --triethoxysilane--.
Table 18 Cont'd., No. 1, "$CH_2$=2 $CHSiCl_3$" should read --$CH_2$=$CHSiCl_3$--.

COLUMN 51

Line 54, "generating," should read --generating--.
Line 67, "are" should read --and are--.

COLUMN 52

Line 16, "bead" should read --head--.
Line 24, "VII" should read --VIII--.

COLUMN 53

Line 1, "VII" should read --VIII--.

UNITED STATES PATENT AND TRADEMARK OFFICE

CERTIFICATE OF CORRECTION

PATENT NO. : 5,485,185

DATED : January 16, 1996

INVENTOR(S) : MANABU SUEOKA ET AL.

It is certified that error appears in the above-identified patent and that said Letters Patent is hereby corrected as shown below:

COLUMN 54

Line 17, "VII" should read --VIII--.

Signed and Sealed this

Ninth Day of July, 1996

*Attest:*

*Attesting Officer*

BRUCE LEHMAN

*Commissioner of Patents and Trademarks*